US011402171B2

(12) United States Patent
Trpkovski

(10) Patent No.: US 11,402,171 B2
(45) Date of Patent: Aug. 2, 2022

(54) CROSSBOW

(71) Applicant: Ravin Crossbows, LLC, Superior, WI (US)

(72) Inventor: Paul Trpkovski, Kailua Kona, HI (US)

(73) Assignee: Ravin Crossbows, LLC, Superior, WI (US)

( * ) Notice: Subject to any disclaimer, the term of this patent is extended or adjusted under 35 U.S.C. 154(b) by 0 days.

(21) Appl. No.: 16/875,564

(22) Filed: May 15, 2020

(65) Prior Publication Data

US 2020/0370856 A1 Nov. 26, 2020

Related U.S. Application Data

(60) Provisional application No. 62/850,499, filed on May 20, 2019, provisional application No. 62/849,668, filed on May 17, 2019.

(51) Int. Cl.
*F41B 5/12* (2006.01)
*F41B 5/00* (2006.01)
*F41B 3/02* (2006.01)

(52) U.S. Cl.
CPC ..... *F41B 5/123* (2013.01); *F41B 3/02* (2013.01); *F41B 5/0094* (2013.01)

(58) Field of Classification Search
CPC ..... F41B 5/12; F41B 5/123; F41B 5/0094; F41B 3/005; F41B 3/02
USPC ..... 124/25, 20.3, 25.6
See application file for complete search history.

(56) References Cited

U.S. PATENT DOCUMENTS 4,169,453 A * 10/1979 Hunsicker ..... F41B 3/02 124/20.1
4,411,248 A * 10/1983 Kivenson ..... F41B 3/02 124/20.1
5,243,955 A * 9/1993 Farless ..... F41B 3/005 124/20.1
5,632,262 A * 5/1997 Hanson ..... F41B 3/02 124/20.1
6,273,078 B1 * 8/2001 Schwesinger ..... F41B 5/12 124/16
7,823,572 B2 * 11/2010 Anderson ..... F41B 5/1469 124/25
7,926,474 B2 * 4/2011 Berry ..... F41B 7/04 124/20.3
8,485,170 B1 * 7/2013 Prior ..... F41B 5/126 124/27
8,522,762 B2 * 9/2013 Trpkovski ..... F41B 5/1453 124/25.6

(Continued)

FOREIGN PATENT DOCUMENTS

WO 2021194387 A1 9/2021

OTHER PUBLICATIONS

International Searching Authority; Partial International Search Report dated Sep. 10, 2020; 14 pages.

(Continued)

*Primary Examiner* — Alexander R Niconovich
(74) *Attorney, Agent, or Firm* — Foley & Lardner LLP

(57) ABSTRACT

A crossbow is configured to shoot a projectile. The crossbow includes a frame defining a horizontal projectile plane. The projectile moves within the horizontal projectile plane when the crossbow is fired. The crossbow includes pulleys and cams to improve performance of the crossbow.

28 Claims, 45 Drawing Sheets

(56) References Cited

U.S. PATENT DOCUMENTS

| | | | | |
|---|---|---|---|---|
| 8,567,376 | B2 * | 10/2013 | Flint | F41B 5/12 124/20.3 |
| 8,651,095 | B2 | 2/2014 | Islas | |
| 8,701,642 | B2 | 4/2014 | Biafore, Jr. et al. | |
| 8,997,728 | B2 * | 4/2015 | Popov | F41B 5/1469 124/25.6 |
| 9,022,013 | B2 | 5/2015 | Trpkovski | |
| 9,052,154 | B1 * | 6/2015 | Prior | F41B 5/126 |
| 9,255,756 | B1 * | 2/2016 | Wu | F41B 5/123 |
| 9,255,764 | B2 * | 2/2016 | Park | F41B 7/003 |
| 9,714,808 | B2 * | 7/2017 | Carroll, Jr. | F41B 5/12 |
| 9,719,749 | B1 * | 8/2017 | Prior | F41B 3/005 |
| 10,240,890 | B2 * | 3/2019 | Trpkovski | F41B 5/12 |
| 10,330,425 | B2 * | 6/2019 | Missel | F41B 5/1426 |
| 10,393,470 | B1 * | 8/2019 | Popov | F41B 5/105 |
| 10,533,822 | B1 * | 1/2020 | Popov | F41B 5/0094 |
| 10,767,956 | B2 * | 9/2020 | Popov | F41B 5/123 |
| 10,962,323 | B2 * | 3/2021 | Langley | F41B 5/1469 |
| 2012/0125302 | A1 * | 5/2012 | Stanziale | F41B 5/123 124/25 |
| 2018/0051954 | A1 * | 2/2018 | Yehle | F41B 5/066 |
| 2018/0172394 | A1 * | 6/2018 | Trpkovski | F41B 5/12 |
| 2018/0340751 | A1 * | 11/2018 | Trpkovski | F41A 11/00 |
| 2020/0182582 | A1 * | 6/2020 | Pauluhn | F41B 5/0094 |
| 2020/0208937 | A1 * | 7/2020 | Popov | F41B 5/123 |
| 2020/0355458 | A1 * | 11/2020 | Langley | F41B 5/1469 |
| 2021/0080218 | A1 * | 3/2021 | Trpkovski | F41B 5/123 |

OTHER PUBLICATIONS

Patent Cooperation Treaty International Searching Authority; Notification of Transmission of the International Search Report and the Written Opinion of the International Searching Authority, or the Declaration; International Application No. PCT/US2020/033214; dated Dec. 3, 2020; 19 pages.

Ravin Crossbows, LLC; U.S. Appl. No. 62/829,913 titled Linear Crossbow; filed Apr. 5, 2019.

Ravin Crossbows, LLC; U.S. Appl. No. 16/840,446 titled Linear Crossbow; filed Apr. 5, 2020.

O'Neal, Bridget; 3DR Holdings; New 3D Printed Viney Compound Bow Prototype Hits the Mark for Fun; 5 pages; Nov. 19, 2014.

* cited by examiner

CROSSBOW

CROSS-REFERENCE TO RELATED APPLICATION(S)

This application claims the benefit of U.S. Provisional Patent Application Ser. No. 62/849,668, filed May 17, 2019 and U.S. Provisional Patent Application Ser. No. 62/850,499, filed May 20, 2019, the disclosures of which are hereby incorporated by reference in their entireties. To the extent appropriate, a claim of priority is made to each of the above-disclosed applications.

BACKGROUND

Crossbows typically include a bow portion, a stock portion, and a draw string latch that holds the bow in the fully drawn position. Typically, the draw string is perpendicular to the arrow or direction of flight. Furthermore, when shooting, the draw string moves aggressively from the drawn position to the rest position to propel the arrow forward.

Commonly, limbs perpendicular to the arrow flight guide the draw string and help to cancel out the recoil generated from firing the crossbow. In order to maintain an adequate power stroke when firing the crossbow, the length and weight of the limbs must be substantial, which increases the overall width and weight of the crossbow. The increased size of the crossbow makes handling and transporting more difficult.

Furthermore, the narrower the crossbow is made, the more difficult guiding the draw string becomes. Also, existing crossbows tend to suffer from left-to-right movement or timing issues of the draw string reducing the accuracy. Numerous camming means have been developed to reduce the draw string wear and make the crossbow narrow, but these suffer from drawbacks such as left-to-right movement of the drawstring.

Currently, crossbows produce speeds in excess of 400 feet per second (FPS); however, most suffer from inefficiencies, safety issues, left-to-right draw movement, and handling and transporting issues due to their size.

Therefore improvements are desired.

SUMMARY

This application generally relates to a crossbow.

One aspect is a crossbow comprising: a frame having a stock positioned at a rear end, the frame defining a horizontal projectile plane at a top side in which a projectile axis is positioned, wherein a projectile moves within the horizontal projectile plane and along the projectile axis during firing and arming of the crossbow, wherein the projectile is fired from a front end of the frame; a drawstring hub rotatable about a central axis in a first direction and a second direction, the central axis being perpendicular to the projectile axis, the drawstring hub being configured to be connected to a drawstring at a first end and a second end, the drawstring traveling at least partially perpendicular to the projectile axis between the first and the second ends, the drawstring being movable within the projectile plane during firing and arming of the crossbow, wherein movement of the drawstring away from the drawstring hub corresponds with rotation of the drawstring hub in the first direction, and wherein movement of the drawstring toward the drawstring hub corresponds with rotation of the drawstring hub in the second direction, wherein rotation of the drawstring hub in the second direction is powered; and first and second drawstring guides attached to the frame, each guide guiding the drawstring across the projectile axis between the first and second ends of the drawstring, wherein the first and second drawstring guides each include a pulley wheel, wherein the drawstring is guided at least partially around each pulley wheel.

Another aspect is a crossbow comprising: a frame having a stock positioned at a rear end, the frame defining a horizontal projectile plane at a top side in which a projectile axis is positioned, wherein a projectile moves within the horizontal projectile plane and along the projectile axis during firing and arming of the crossbow, wherein the projectile is fired from a front end of the frame; a drawstring hub rotatable about a central axis in a first direction and a second direction, the central axis being perpendicular to the projectile axis; a drawstring being connected to the drawstring hub at a first end and a second end, the drawstring traveling at least partially perpendicular to the projectile axis between the first and the second ends, the drawstring being movable within the projectile plane during firing and arming of the crossbow, wherein movement of the drawstring away from the drawstring hub corresponds with rotation of the drawstring hub in the first direction, and wherein movement of the drawstring toward the drawstring hub corresponds with rotation of the drawstring hub in the second direction; a latch configured to hold the drawstring at the rear end of the frame when the crossbow is drawn; a trigger assembly in communication with the latch, wherein upon activation of the trigger assembly when firing, the trigger assembly moves the latch and the drawstring is released; first and second flexible limbs each having a first end attached to the frame, wherein the first and second flexible limbs are in an unloaded position when the crossbow is undrawn and in a loaded positioned when the crossbow is drawn; first and second power cables each having first and second ends, wherein the first ends of the first and second power cables are attached to the drawstring hub, wherein the second end of the first power cable is attached to second end of the first limb and the second end of the second power cable is attached to second end of the second limb, wherein upon rotation in the first direction of the drawstring hub, the first and second power cables draw the second end of each first and second flexible limb closer to the drawstring hub; and first and second drawstring guides attached to the frame, each guide guiding the drawstring across the projectile axis between the first and second ends of the drawstring.

A further aspect is a crossbow having a frame comprised of a first frame portion and a second frame portion that are detachably coupled to one another via a fastening mechanism.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

FIG. 1 illustrates the crossbow in a drawn position.

FIG. 18 illustrates the crossbow in a drawn position.

FIG. 27 illustrates the crossbow in a drawn position.

FIG. 37 illustrates the crossbow assembled and in an undrawn position.

DETAILED DESCRIPTION

Various embodiments will be described in detail with reference to the drawings, wherein like reference to numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

A crossbow disclosed herein can be used in different arrangements to improve efficiency, improve balance, improve safety, shoot different projectiles, and improve accuracy. The crossbow may include one or more of the following features: 1) forward vertically facing limbs mounted parallel to a draw string with guide pulleys; 2) rear facing parallel limbs with guide pulleys; and 3) forward facing parallel limbs with guide pulleys. With these features, the crossbow has a compact design, is accurate, is efficient, and is safe to operate. Also disclosed herein, a crossbow having any one of these features can be a takedown crossbow comprised of two separate frame portions that can be repeatedly detached to facilitate transport and storage, for example, and securely re-attached via a fastening mechanism.

Figure 1:
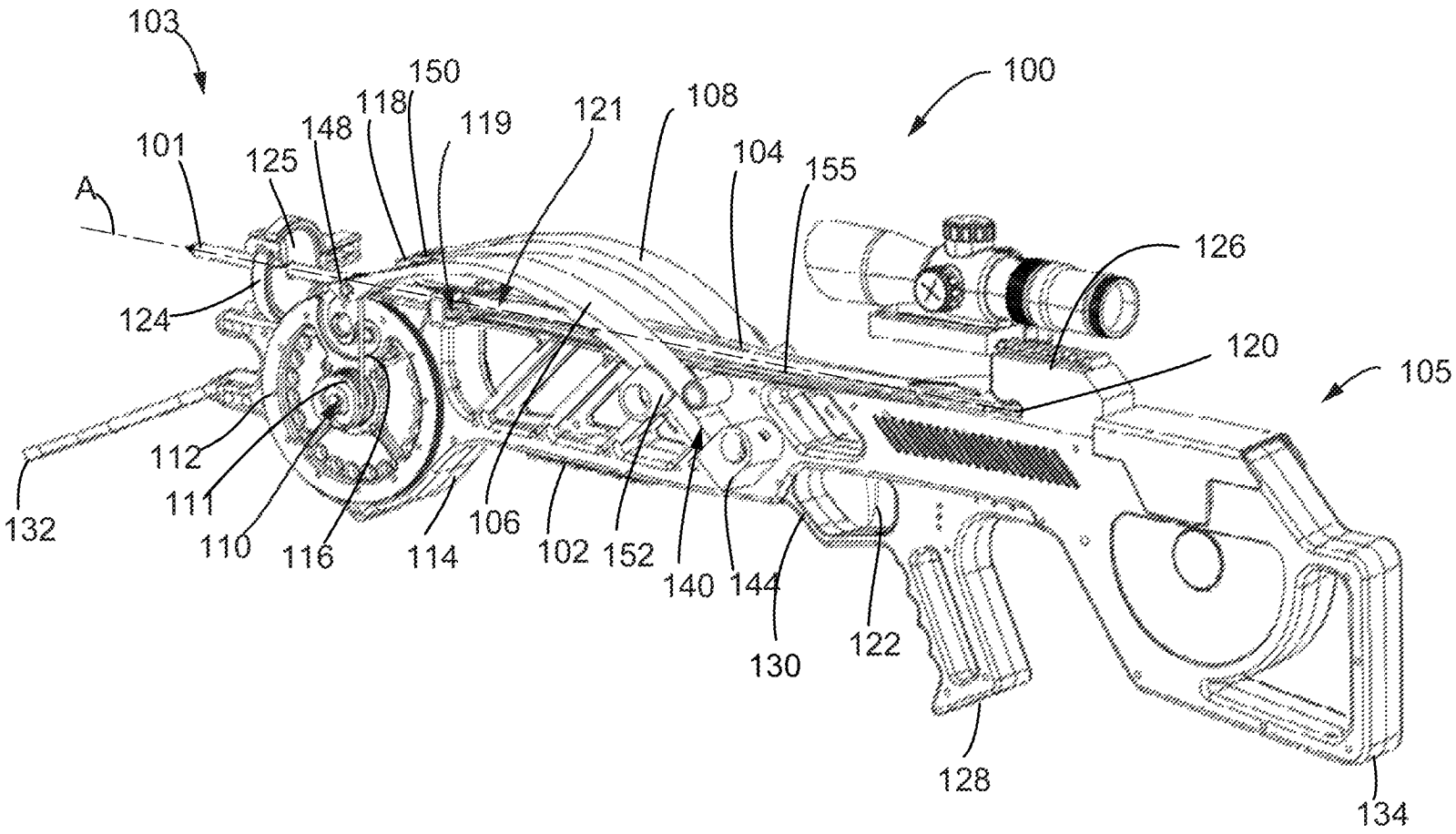
FIG. 1 is a left side perspective view of a crossbow according to the principles of the present disclosure; in particular
Figure 2:
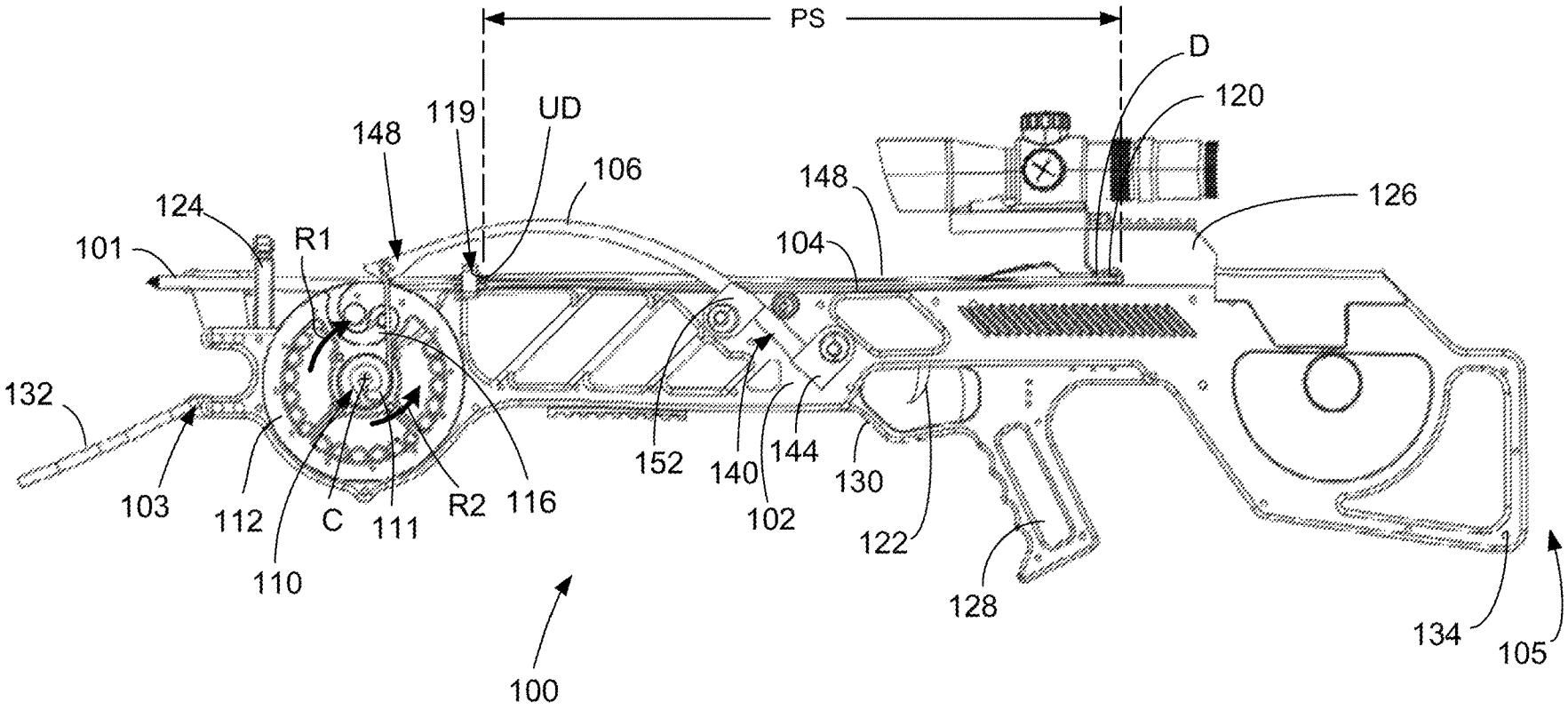
FIG. 2 is a left side view of the crossbow of FIG. 1 in the drawn position.
Figure 3:
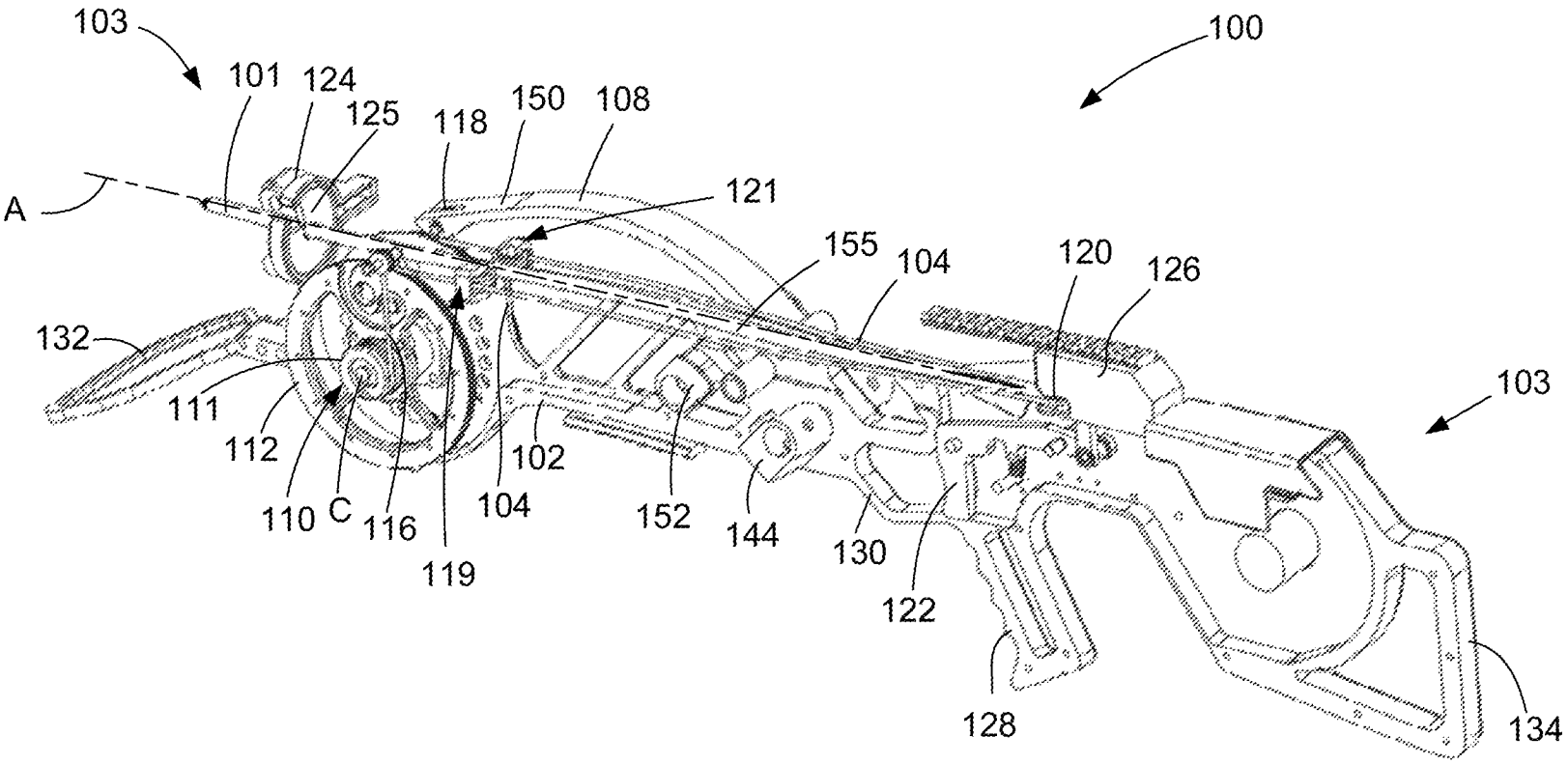
FIG. 3 is a left side cross section view of the crossbow of FIG. 1 in the drawn position.

FIGS. 1-17 illustrate an example of a crossbow 100 according to the principles of the present disclosure. FIG. 1 shows a perspective view of the crossbow 100. FIG. 2 shows a side view of the crossbow 100. FIG. 3 shows a perspective longitudinal cross section of the crossbow 100.

The crossbow 100 is configured to fire a projectile 101, such as an arrow. The crossbow 100 includes a frame 102, a drawstring 104, a first limb 106, a second limb 108, a drawstring hub 110, a first drawstring wheel 111, a second drawstring wheel 113, a first power wheel 112, a second power wheel 114, a first power cable 116, a second power cable 118, a first drawstring guide 119, a second drawstring guide 121, a latch 120, and a trigger assembly 122. The crossbow also can include an arrow rest 124, an accessory rail 126, a grip 128, a trigger guard 130, a foot stirrup 132, and a stock 134.

The crossbow 100 is shown in a drawn position where the drawstring 104 is positioned at a rear end 105 of the frame 102. When fired, the projectile 101 moves within a horizontal projectile plane and along a projectile axis A, and the crossbow 100 fires the projectile 101 from a front end 103 of the crossbow 100. In some examples, the crossbow 100 is generally symmetrical about the projectile axis A.

The frame 102 can be constructed of a composite, wood, metal, or like material. In some examples, the frame 102 is a singular unibody component. In other examples, the frame 102 has a multiple piece construction. In some examples, the frame 102 is configured to include a variety of different mounting points for various module accessories such as flashlights, sighting accessories, or other attachments.

The drawstring 104 is connected to the drawstring hub 110 at a first end 136 and at a second end 138 of the drawstring. The drawstring 104 travels at least partially perpendicular to the projectile axis A between the first and the second ends 136, 138. The drawstring 104 is movable within the projectile plane during firing and arming of the crossbow 100. To draw to the drawstring 104, the crossbow 100 is stabilized and the drawstring 104 is pulled to the rear end 105 of the frame 102. An arming device, the users arm, or other like mechanism can be used to draw the drawstring 104.

In some examples, an arming device can be a crank and a hook. In some examples, the arming device is located in the frame 102 of the crossbow and connectable to the drawstring 104 for drawing the drawstring 104 to the rear end 105 of the frame 102.

Movement of the drawstring 104 away from the drawstring hub 110 corresponds with rotation of the drawstring hub 110 in a first direction R1, and movement of the drawstring 104 toward the drawstring hub corresponds with rotation of the drawstring hub 110 in a second direction R2. Rotation of the drawstring hub 110 in the second direction R2 is powered. In some examples, the rotation of the drawstring hub 110 is powered by the first and second limbs 106, 108. In some examples, the rotation of the drawstring hub 110 can be powered by a power source such as, but not limited to, a spring, a motor, a piston, or like device. In some examples, rotation of the drawstring hub 110 in the first direction R1 is powered. In some examples, rotation of the drawstring hub 110 in the second direction R2 is powered by the limbs 106 and 108. The drawstring 104 can be constructed of traditional bowstring material such as, but not limited to, composite and/or natural fibers.

As shown in FIG. 2, the drawstring 104 is movable along a power stroke PS when arming and firing the crossbow 100. The power stroke PS is defined by the distance between an undrawn position UD and a drawn position D of the drawstring 104.

The limbs 106 and 108 are flexible and are attached to the frame 102 at first ends 140, 142 of the limbs, at main supports 144, 146, and attached to the power cables 116, 118 at second ends 148, 150 of the limbs. In some examples, the limbs 106, 108 are elastic and spring-like in nature. In some examples, the limbs 106, 108 are also supported at mid supports 152, 154 between the main supports 144, 146 and the second ends 148, 150. In some examples, the mid supports 152, 154 are used as fulcrums to bend the limbs 106 and 108, and the limbs 106 and 108 are not attached to the mid supports 152, 154.

In some examples, the limbs 106, 108 extend in an upward direction from a top side 155 of the frame 102 and in a forward direction toward the front end 103 of the frame 102. It is considered within the scope of the present disclosure that the limbs 106, 108 may be positioned in a variety of different ways relative to the frame 102.

The limbs 106 and 108 are shown as being vertical and generally perpendicular to the horizontal projectile plane that contains the projectile axis A. The limbs 106, 108 are positioned at either side of the frame 102 such that the projectile 101 passes between the limbs 106, 108. In some examples, the limbs 106 and 108 are oriented to create a very narrow crossbow 100 in either the drawn or the undrawn position. In some examples, a width of between the limbs 106, 108 is less than or equal to 8.0 inches. In some examples, the width is less than or equal to 3.5 inches and preferably around 3.0 inches.

The first and second limbs 106, 108 are in an unloaded position (FIG. 11-12) when the crossbow is undrawn and in a loaded positioned (FIGS. 1-2) when the crossbow 100 is drawn. Rotation of the drawstring hub 110 in the second direction R2 is powered by the first and second flexible limbs 106, 108. During drawing, the limbs 106, 108 are drawn down by the power cables 116, 118, thus letting out drawstring 104 until the desired power stroke PS is reached and the drawstring 104 is held near the rear end 105 by the latch 120. When the crossbow 100 is fired from the drawn position, a tension force in the limbs 106, 108 moves the drawstring 104 toward the front end 103 of the frame 102. The draw weight, or force required to arm the crossbow 100, relies on the type of limbs used. In some examples, a draw weight of the crossbow is between 5 lbs and 400 lbs and preferably about 150 lbs.

The drawstring hub 110 includes the first and second drawstring wheels 111, 113 and the first and second power wheels 112, 114. In some examples, the first and second drawstring wheels 111, 113 are integrally formed with the drawstring hub 110. In some examples, the first and second drawstring wheels 111, 113 and the first and second power wheels 112, 114 rotate with one another. The drawstring hub 110 is rotatably mounted to the frame 102 at the front end 103. The drawstring hub 110 is rotatable about a central axis C in the first and second directions R1, R2. In some examples, the central axis C is perpendicular to the projectile axis A. The first and second power cables 116, 118 and the drawstring 104 are connected to the drawstring hub 110, specifically to the first and second drawstring wheels 111, 113, and can cause rotation thereof. In some examples, the first and second power cables 116, 118 are wound around the first and second drawstring wheels 111, 113 when drawing the crossbow 100. In some examples, the first and second power cables 116, 118 are unwound from the first and second drawstring wheels 111, 113 when firing the crossbow 100. In some examples, the drawstring 104 is unwound from the drawstring hub 110 when drawing the crossbow 100. In some examples, the drawstring 104 is wound around the drawstring hub 110 when drawing the crossbow 100.

The first and second power wheels 112 and 114 are mounted to the drawstring hub 110 so as to rotate with the drawstring hub 110. In some examples, the first and second power wheels 112, 114 are integrally formed with the drawstring hub 110. In some examples, the first and second power wheels 112, 114 are separate from, but mounted to, the drawstring hub 110. In some examples, the first and second power wheels 112, 114 have diameters greater than a diameter of the drawstring hub 110. In some examples, the power wheels 112, 114 have diameters between 1.0 inches and 12 inches. In some examples, the power wheels 112, 114 have diameters of 5.0 inches.

The first end 136 of the drawstring 104 is attached to the first power wheel 112 and the second end 138 of the drawstring 104 is attached to the second power wheel 114. In some examples, when undrawn, the drawstring 104 is wrapped around the first and second power wheels less than or equal to one time. In some examples, the first and second power wheels 112 and 114 can have circumferential grooves to guide the drawstring 104 therein.

The first and second drawstring guides 119, 121 are attached to the frame 102. Each guide 119, 121 guides the drawstring 104 across the projectile axis A between the first and second ends 136, 138 of the drawstring 104. In some examples, the first and second drawstring guides 119, 121 help to maintain the timing of either side of the drawstring 104 during firing so that the drawstring 104 propels the projectile 101 in an even manner. Further, because firing the crossbow 100 is a violent act, the first and second drawstring guides 119, 121 help to keep the fast moving drawstring 104 aligned to allow the drawstring 104 to be wound around the first and second power wheels 112 and 114. The first and second drawstring guides 119, 121 will be discussed further herein.

The latch 120 is configured to hold the drawstring 104 at the rear end 105 of the frame when the crossbow 100 is drawn. In some examples, the latch 120 can interface with a shuttle attached to the drawstring 104.

The trigger assembly 122 is in communication with the latch 120 so that upon activation of the trigger assembly 122 when firing (e.g., pulling the trigger toward the rear end 105 of the frame 102) the trigger assembly 122 moves the latch 120 and the drawstring 104 is released and free to travel toward the front end 103 of the frame 102. The trigger assembly 122 can include an auto safety and anti-dry fire protection.

The arrow rest 124 is mounted to the front end 103 of the frame 102 and includes an opening 125 that is aligned with projectile axis A. In some examples, the arrow rest 124 includes bristles positioned within the opening 125 for supporting the projectile 101.

The accessory rail 126 is positioned at the top side 155 of the frame 102. In some examples, the rail can be a picatinny rail. In some examples, the accessory rail 126 is configured to receive a sighting apparatus, such as a scope. In some examples, the accessory rail 126 is positioned between 5.0 inches and 30 inches from an end of the stock 134. In some examples, the accessory rail 126 is adjustable. In some examples, the accessory rail 126 is positioned above the latch 120, so when drawn, the drawstring 104 is positioned below the accessory rail 126. In some examples, when drawn, the drawstring 104 passes at least partially through the accessory rail 126.

The grip 128 and the trigger guard 130 help to aid a user of the crossbow 100. The grip 128 provides a point of support for the user of the crossbow 100 and can be held by the user's hand, including when operating the trigger assembly 122. The grip 128 assists the user in stabilizing the crossbow 100 during firing and handling. In some embodiments, the grip 128 is mounted to the frame 102.

The foot stirrup 132 can optionally be used by the user to brace the crossbow 100 when drawing the crossbow 100. In some examples, a user can place a foot in the foot stirrup 132 during drawing of the crossbow 100.

Figure 4:
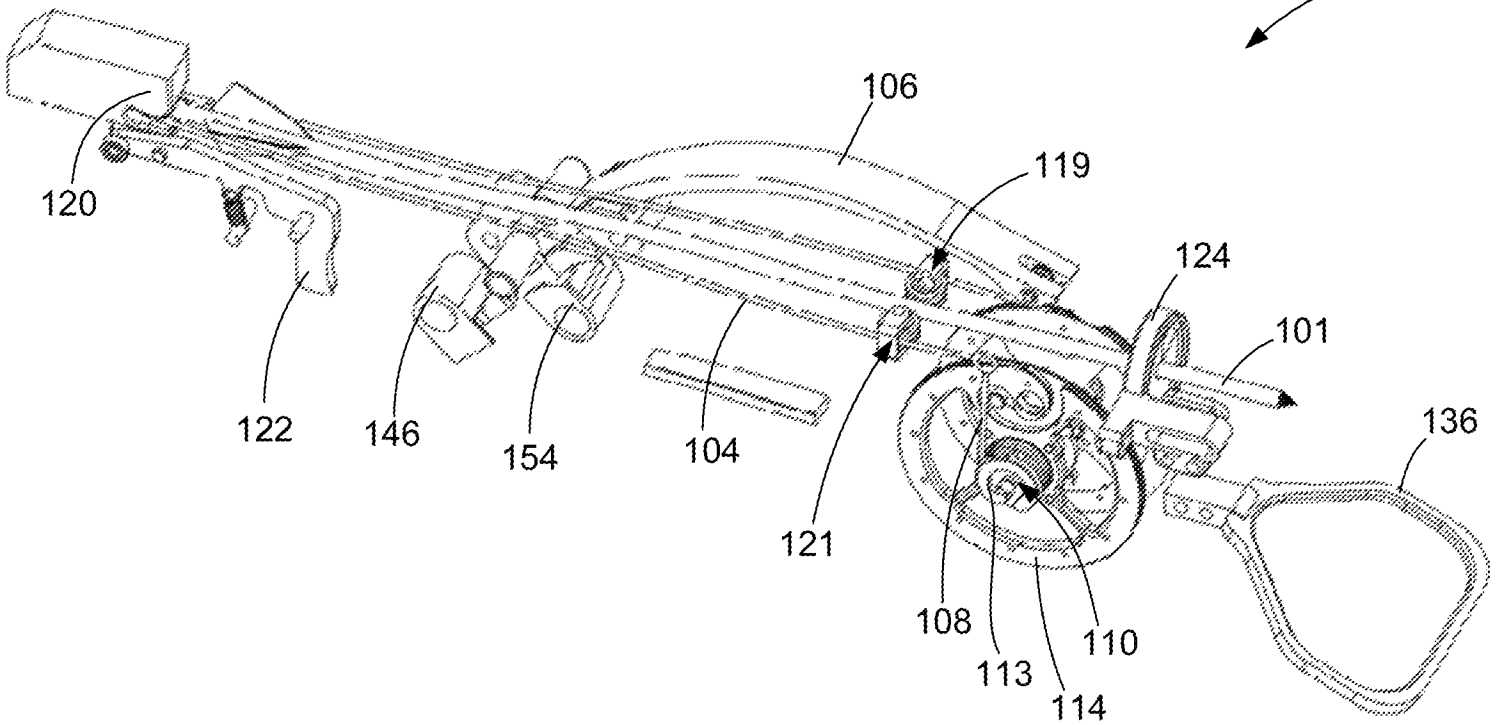
FIG. 4 is a right side perspective view of a portion of the crossbow of FIG. 1 in the drawn position.

FIG. 4 shows a perspective view of a portion of the crossbow 100 with the drawstring 104 drawn. The frame 102 and second limb 108 are not shown for simplicity.

Figure 5:
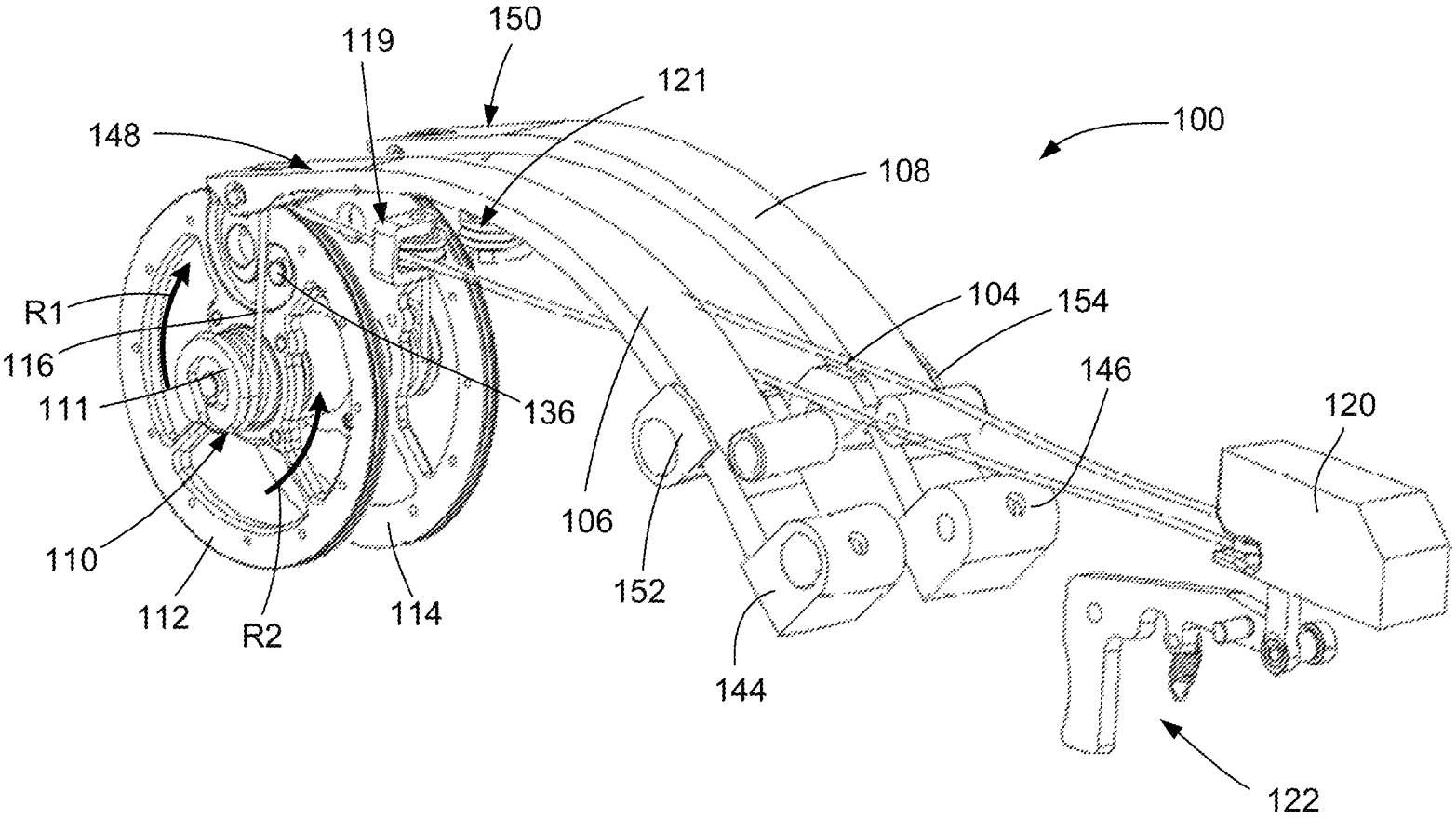
FIG. 5 is a left side perspective view of another portion of the crossbow of FIG. 1 in the drawn position.
Figure 6:
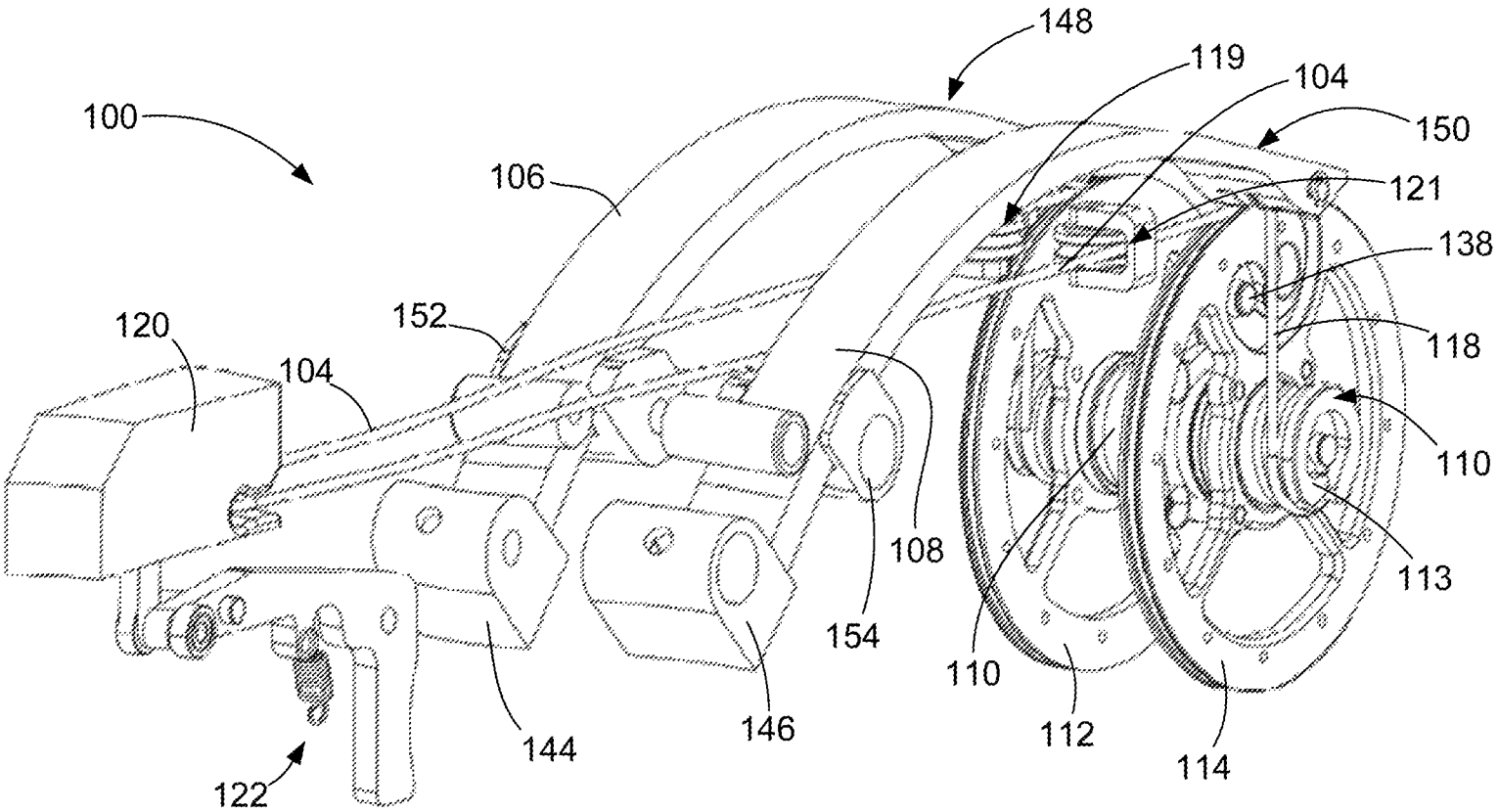
FIG. 6 is a right side perspective view of the portion of the crossbow of FIG. 5 in the drawn position.
Figure 7:
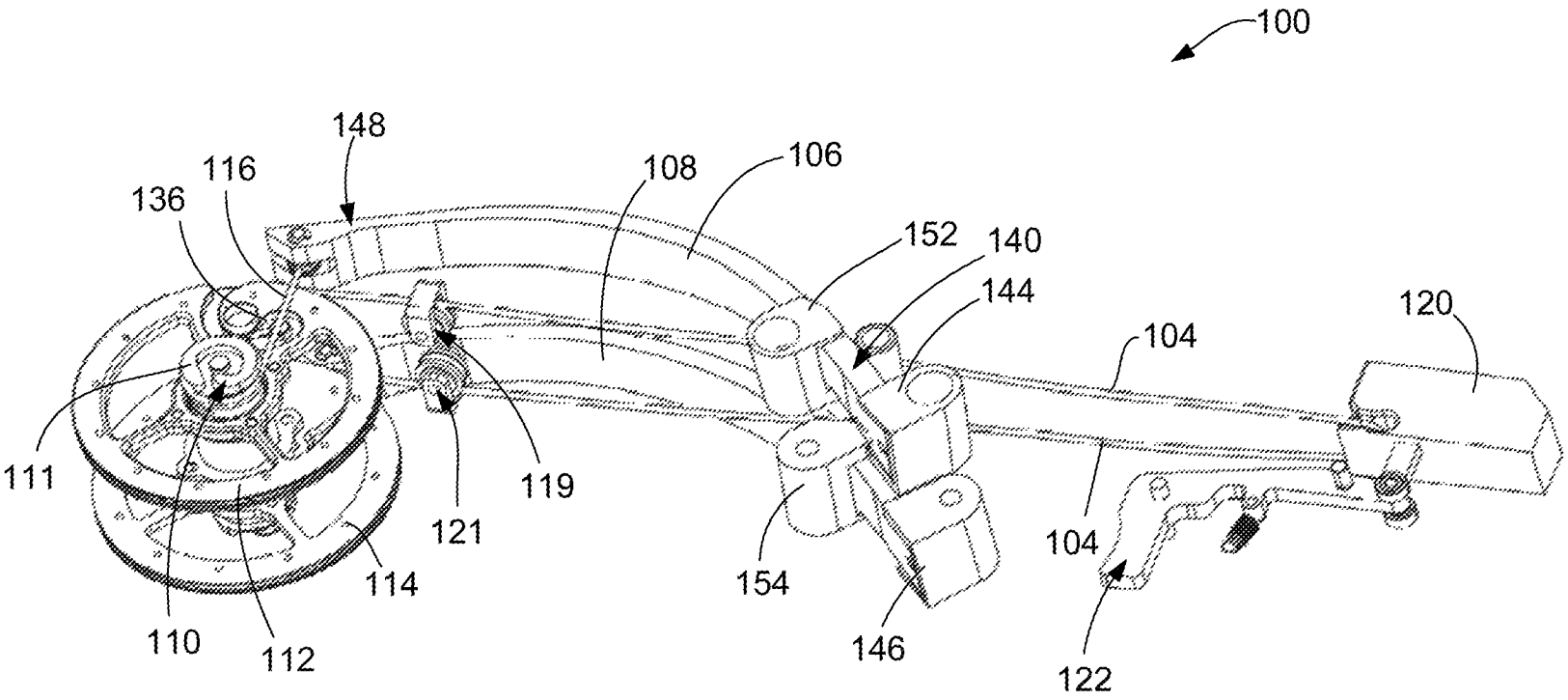
FIG. 7 is a bottom perspective view of the portion of the crossbow of FIG. 5 in the drawn position.

FIG. 5 shows a rear perspective view of a portion of the crossbow 100 with the drawstring 104 drawn. FIG. 6 shows another rear perspective view of a portion of the crossbow 100 with the drawstring 104 drawn. FIG. 7 shows a perspective view of a portion of the crossbow 100 with the drawstring 104 drawn.

Figure 8:
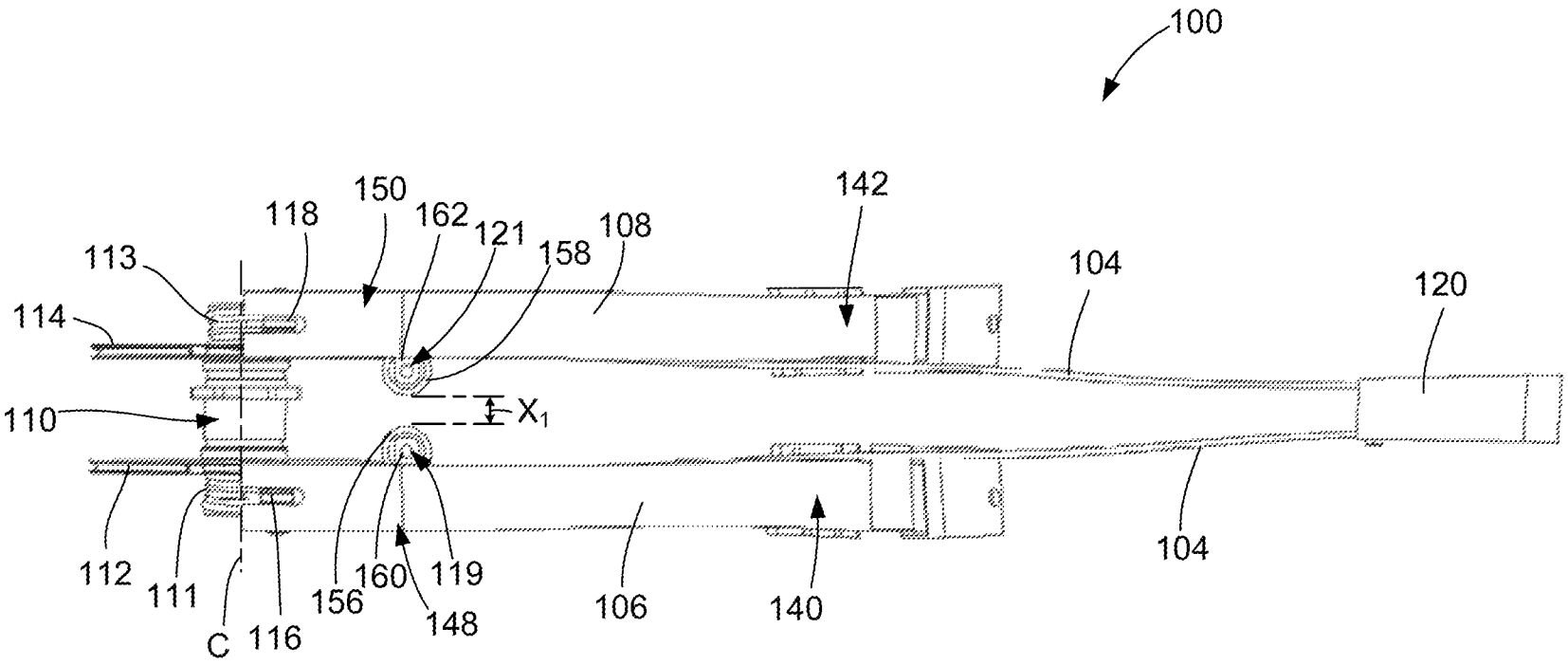
FIG. 8 is a top side view of the portion of the crossbow of FIG. 5 in the drawn position.
Figure 9:
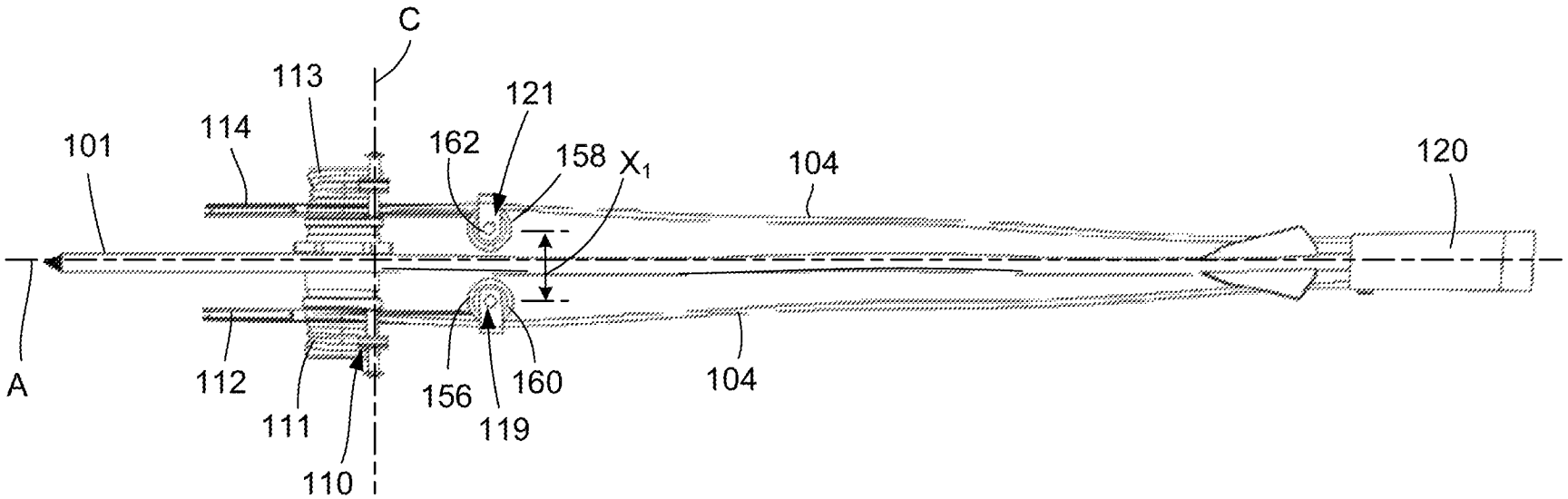
FIG. 9 is a top side view of another portion of the crossbow of FIG. 1 in the drawn position.

FIGS. 8 and 9 show top views of a portion of the crossbow 100 with the drawstring 104 drawn. As shown, the central axis C is perpendicular to the projectile axis A.

The first and second drawstring guides 119, 121 each include a pulley wheel 156, 158 respectively. The drawstring 104 is guided at least partially around each pulley wheel 156, 158. In some examples, each pulley wheel 156, 158 is rotatable and includes a bearing. In other examples, each pulley wheel 156, 158 is fixed and not rotatable. In other examples, each pulley wheel 156, 158 is only a portion of a full wheel. In some examples, each pulley wheel 156, 158 includes a groove within which the drawstring 104 is positioned and moves. In some examples each pulley wheel 156, 158 is mounted to a frame 160, 162. In some examples, each pulley wheel 156, 158 is spring loaded with respect to the frames 160, 162. In some examples, the pulley wheels 156, 158 each have a diameter between 0.125 inches and 6.00 inches. In some examples, the diameter of the pulley wheels 156, 158 is 0.80 inches.

In order to maintain a clear path for the projectile 101 and maintain a narrow crossbow profile, the pulley wheels 156, 158 are separated from one another at a distance X1. In some examples, the distance X1 is between 0.5 inches and 8.0 inches. In some examples, the distance X1 is 1.5 inches.

By guiding the drawstring 104 with first and second drawstring guides 119, 121, between the first and second ends 136, 138 of the drawstring 104, left-to-right movement of the projectile 101 is reduced. And because a single drawstring 104 is used, the rate at which the drawstring 104 is wound around the drawstring hub 110, specifically the power wheels 112, 114, when the crossbow 100 is fired is equalized, thus reducing potential timing issues with drawstring 104 winding around the power wheels 112, 114.

Figure 10:
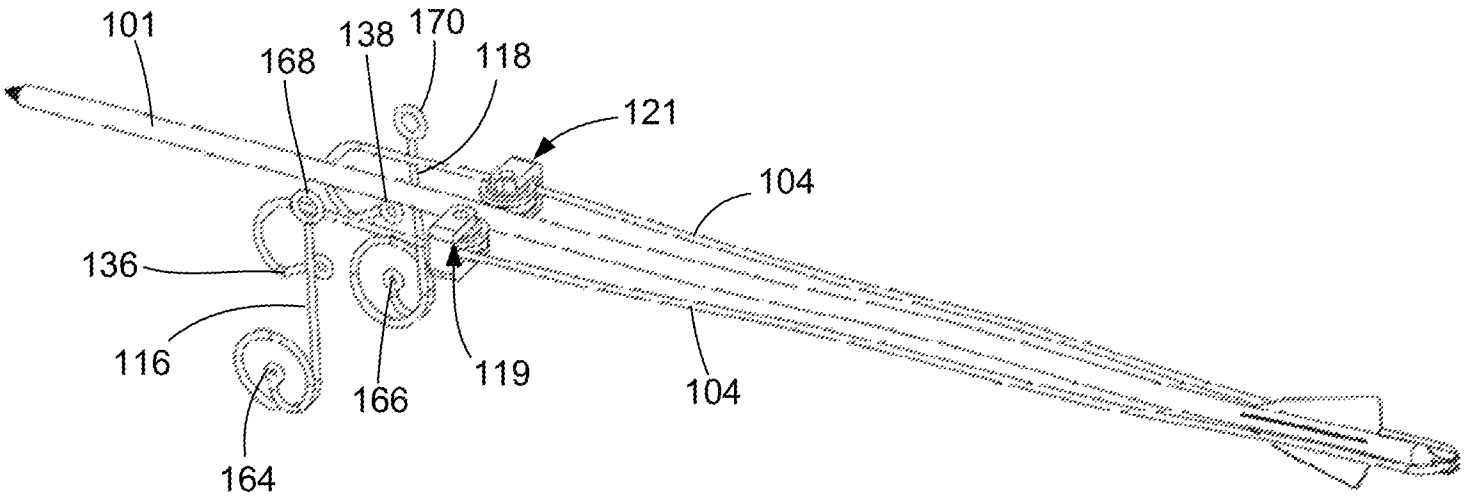
FIG. 10 is a perspective view of another portion of the crossbow of FIG. 1 in the drawn position.
Figure 11:
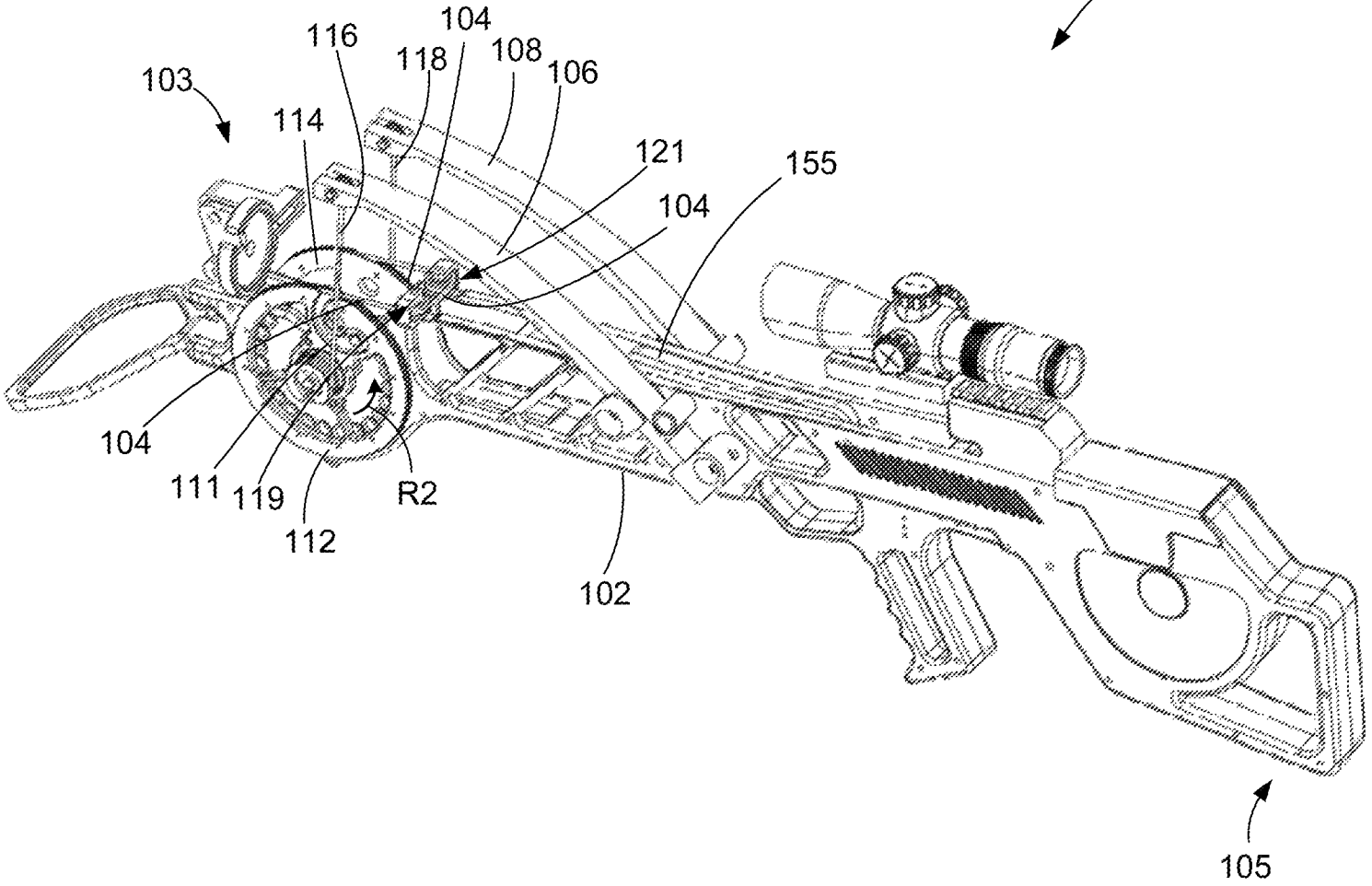
FIG. 11 is a left side perspective view of the crossbow of FIG. 1 in an undrawn position.
Figure 12:
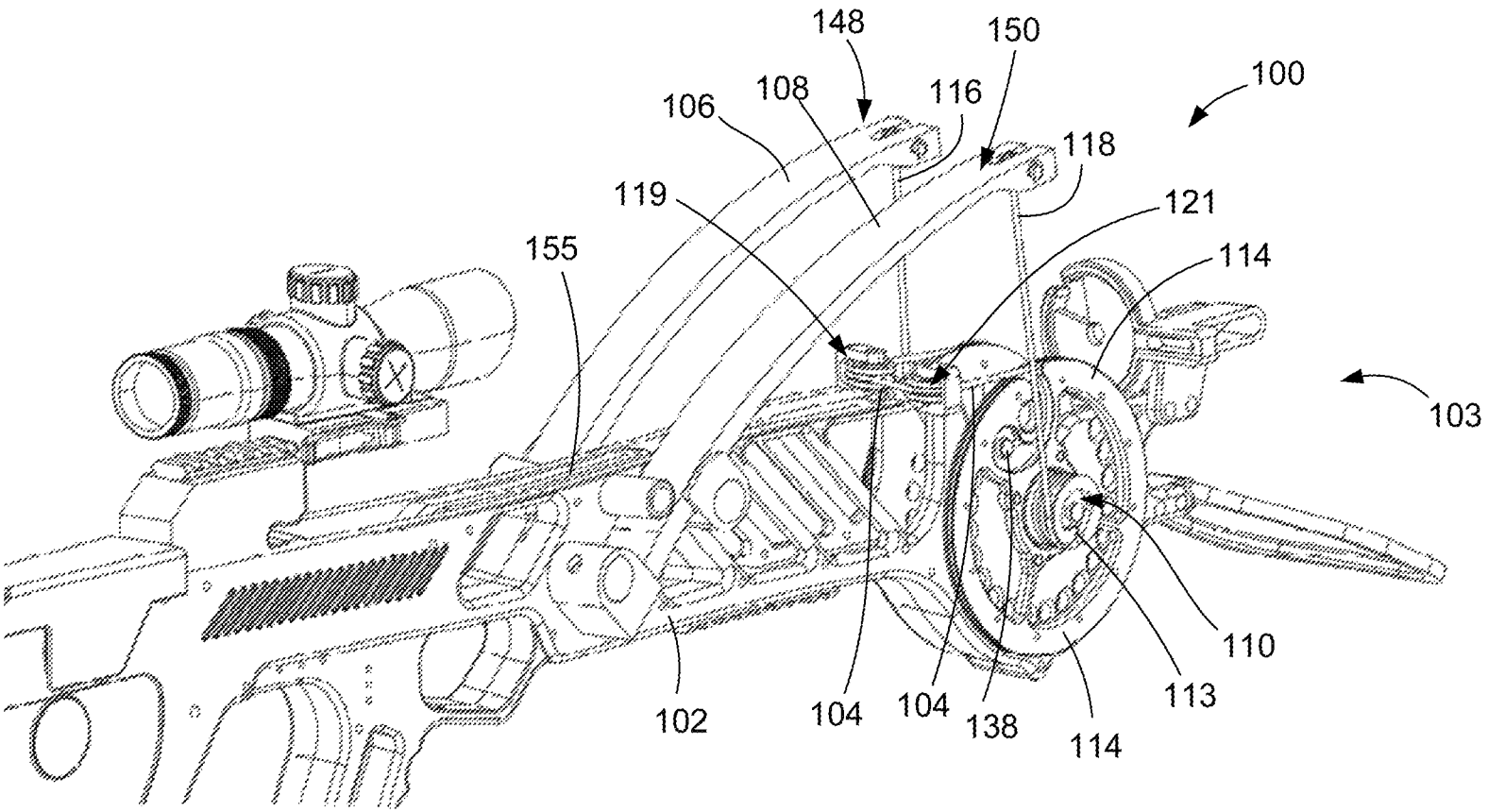
FIG. 12 is a right side perspective view of the crossbow of FIG. 11 in the undrawn position.
Figure 13:
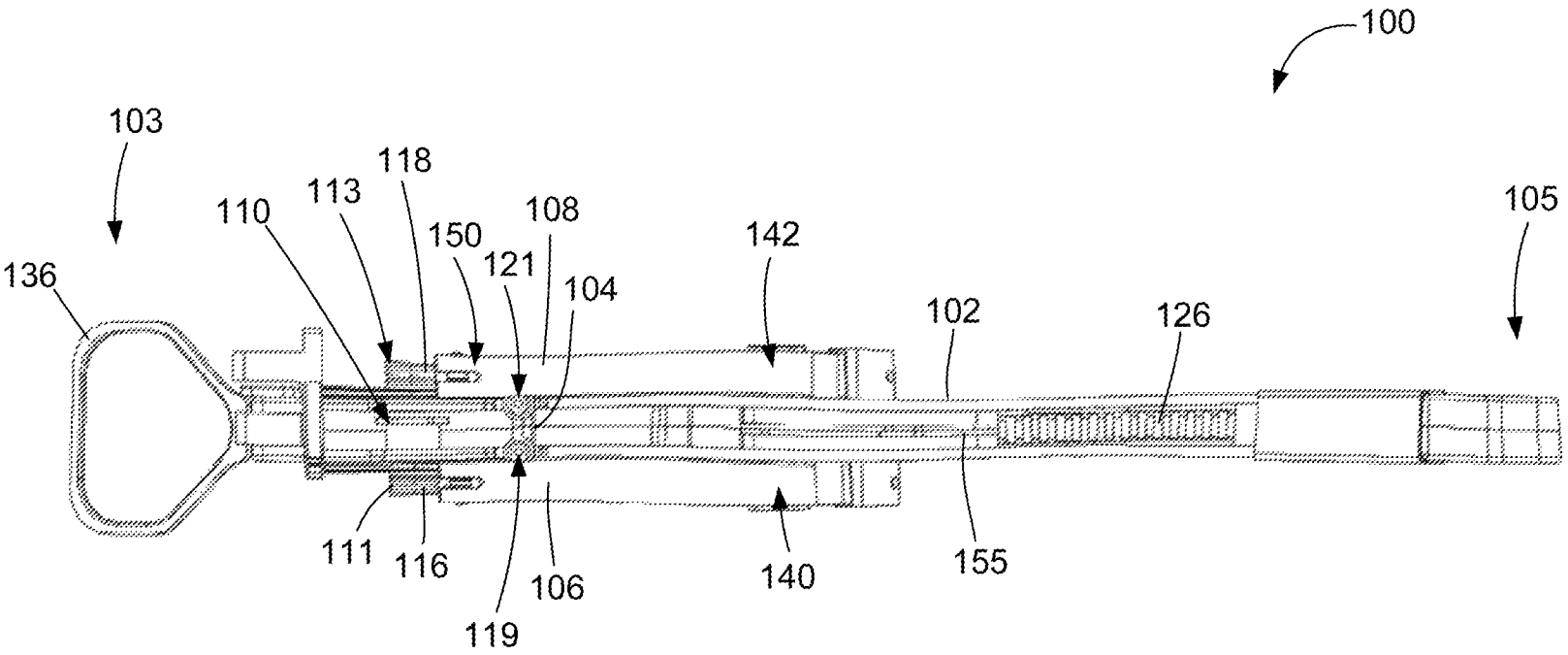
FIG. 13 is a top side view of the crossbow of FIG. 11 in the undrawn position.
Figure 14:
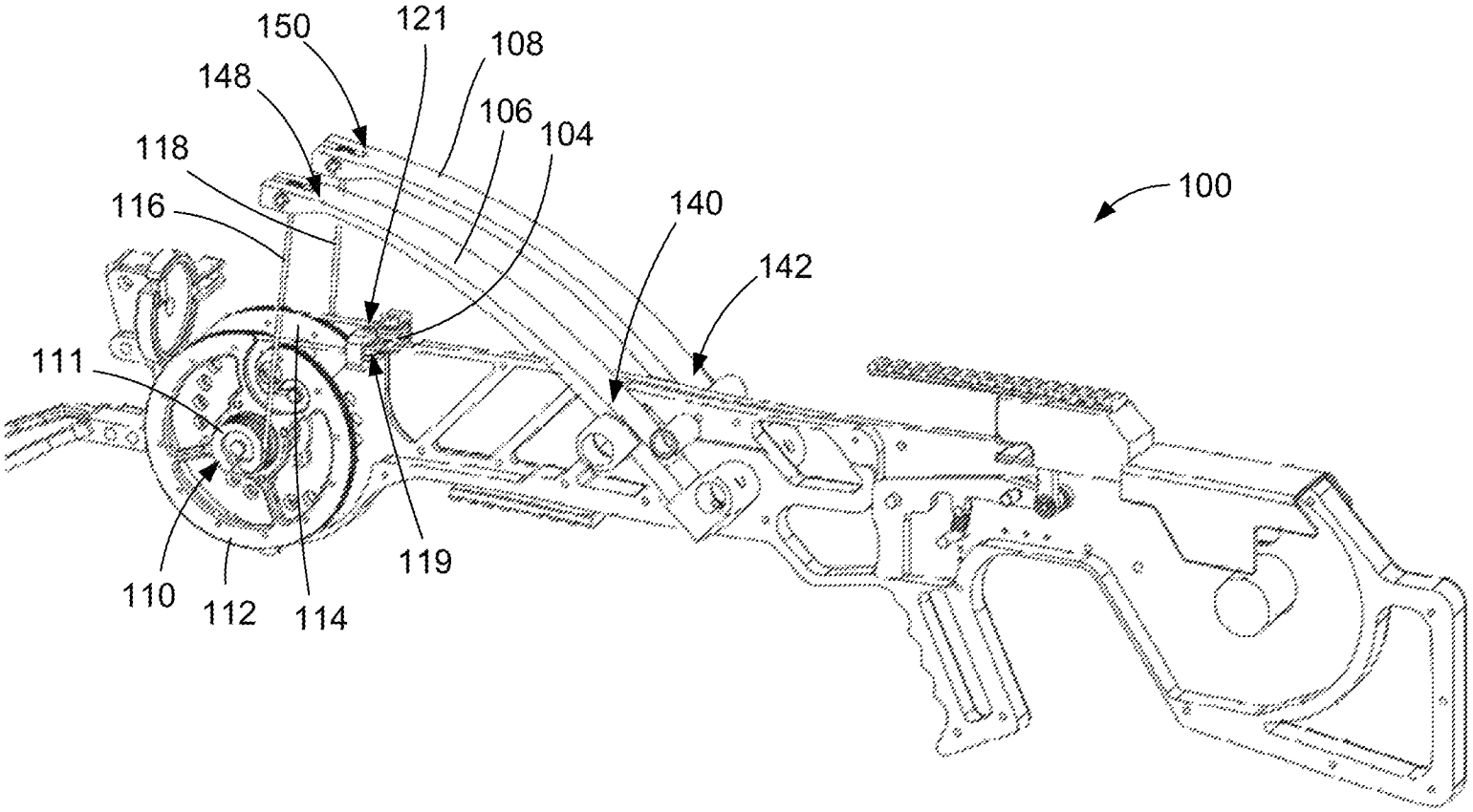
FIG. 14 is a left side cross section view of the crossbow of FIG. 11 in the undrawn position.
Figure 15:
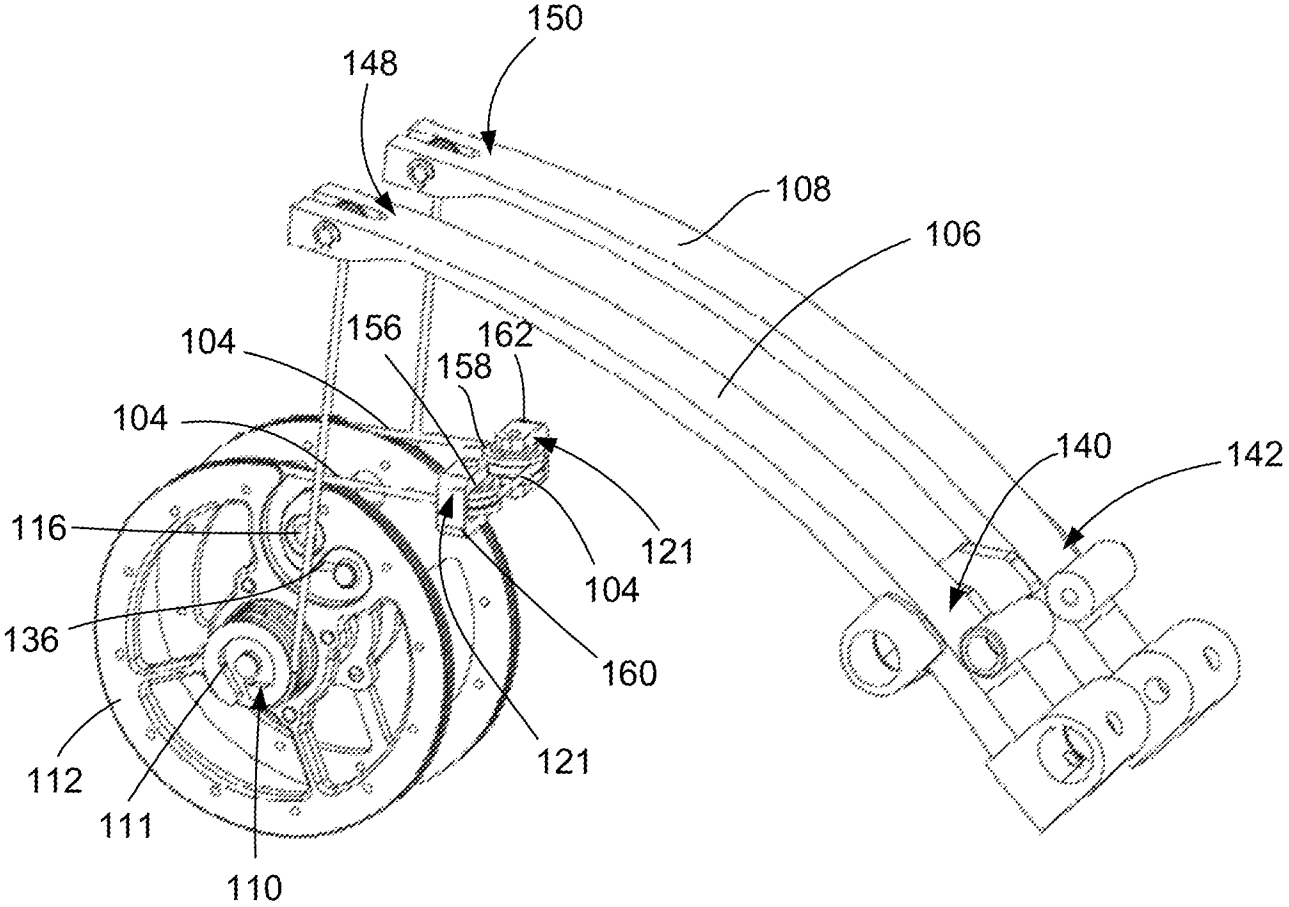
FIG. 15 is a left side perspective view of a portion of the crossbow of FIG. 11 in the undrawn position.
Figure 16:
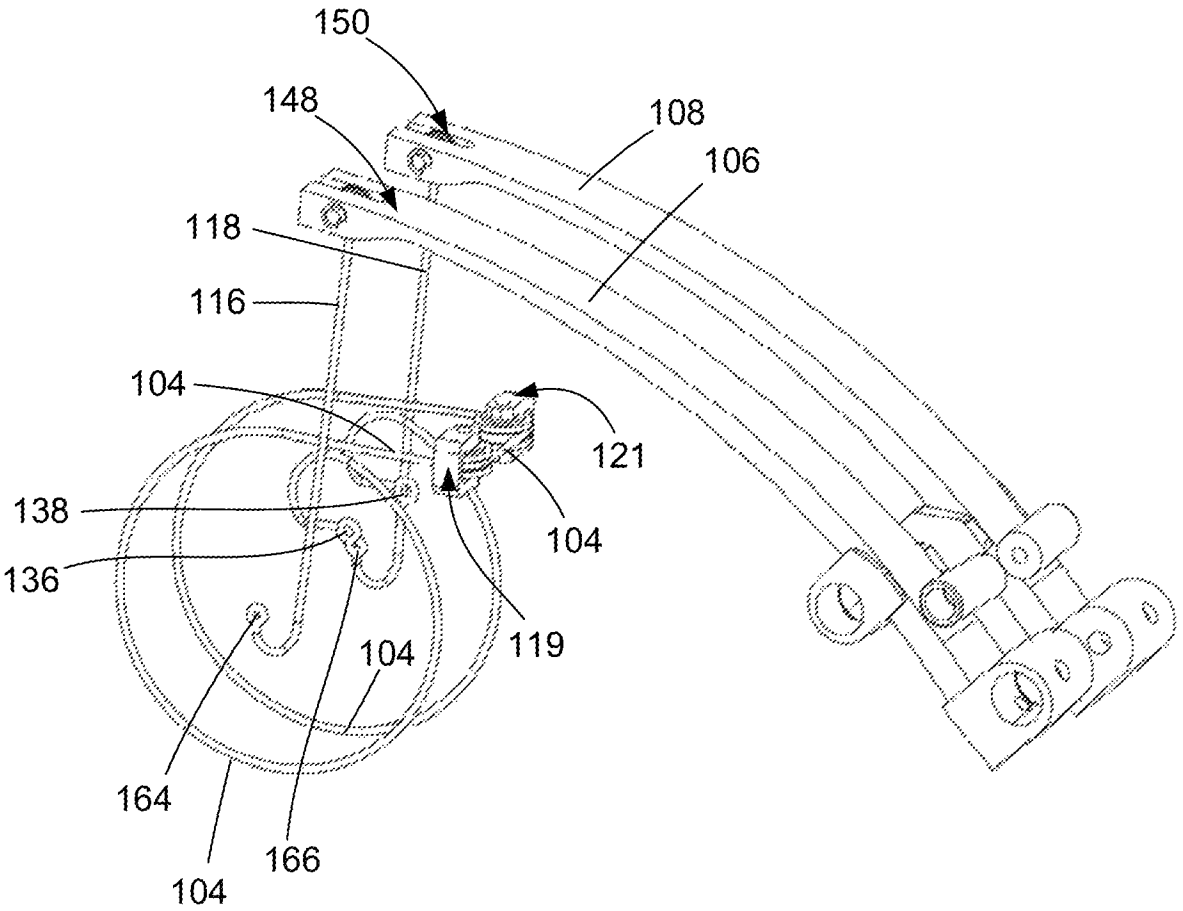
FIG. 16 is another left side perspective view of a portion of the crossbow of FIG. 11 in the undrawn position.
Figure 17:
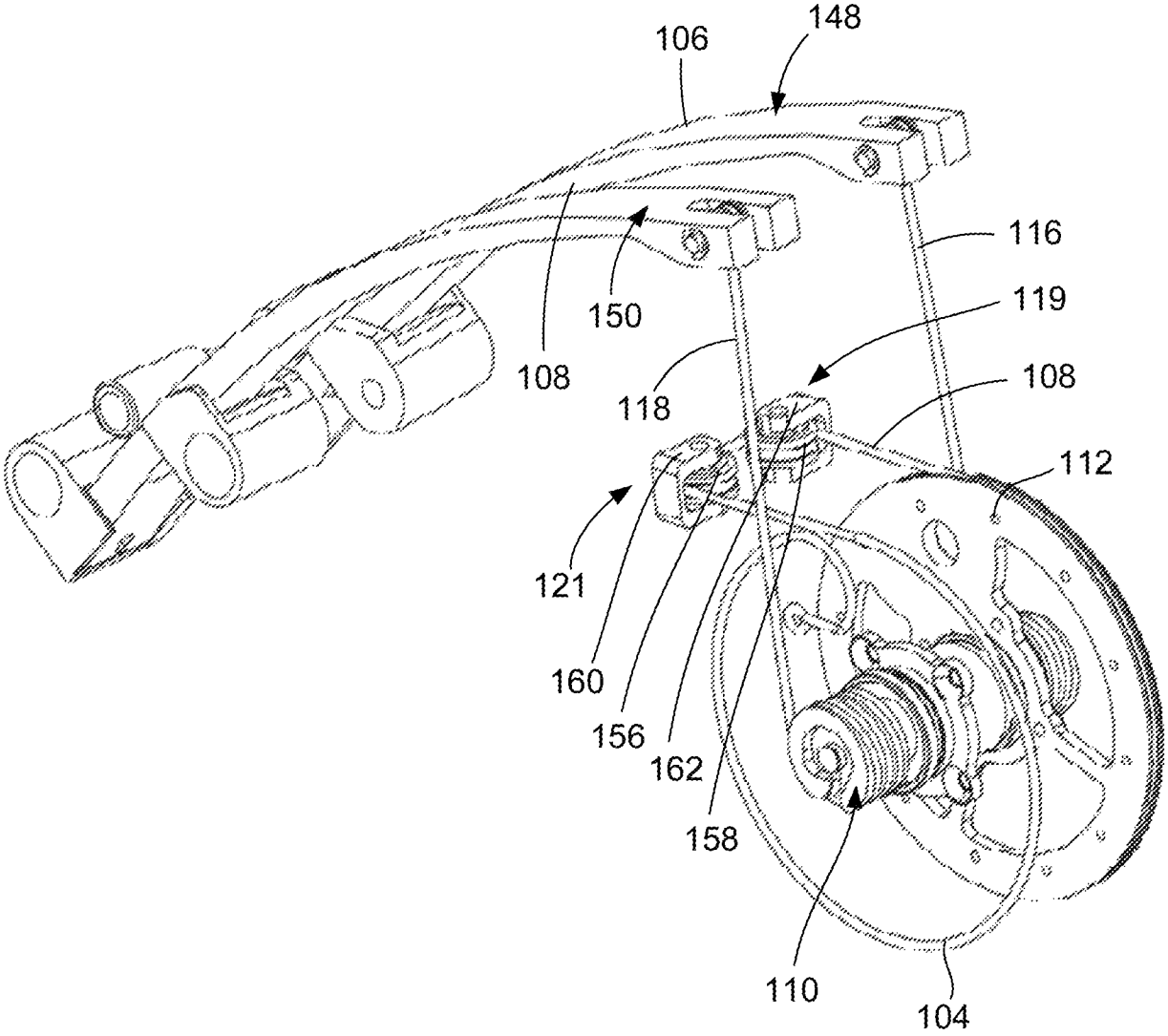
FIG. 17 is a right side perspective view of a portion of the crossbow of FIG. 11 in the undrawn position.
Figure 18:
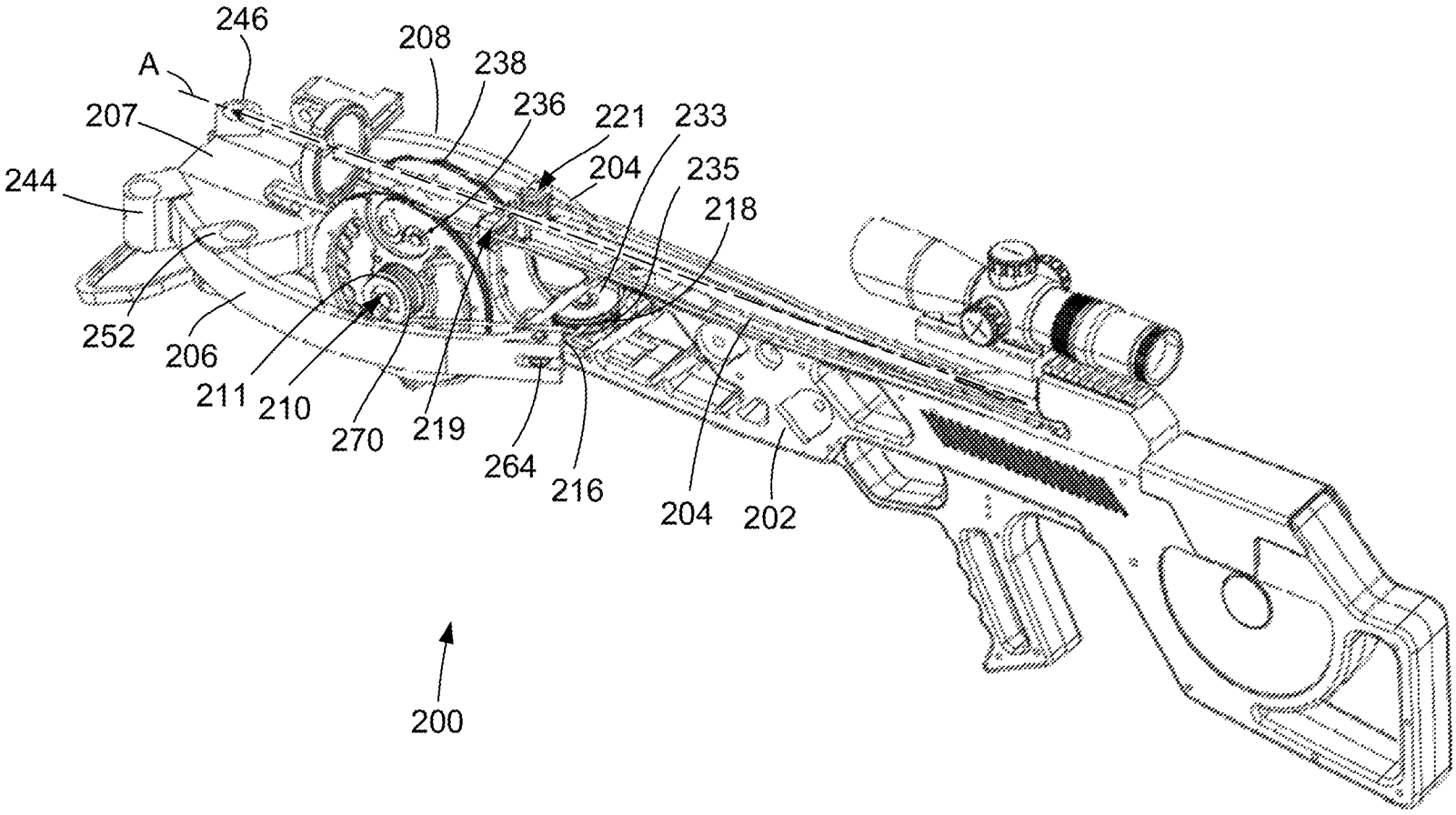
FIG. 18 is a left side perspective view of a crossbow according to the principles of the present disclosure; in particular
Figure 19:
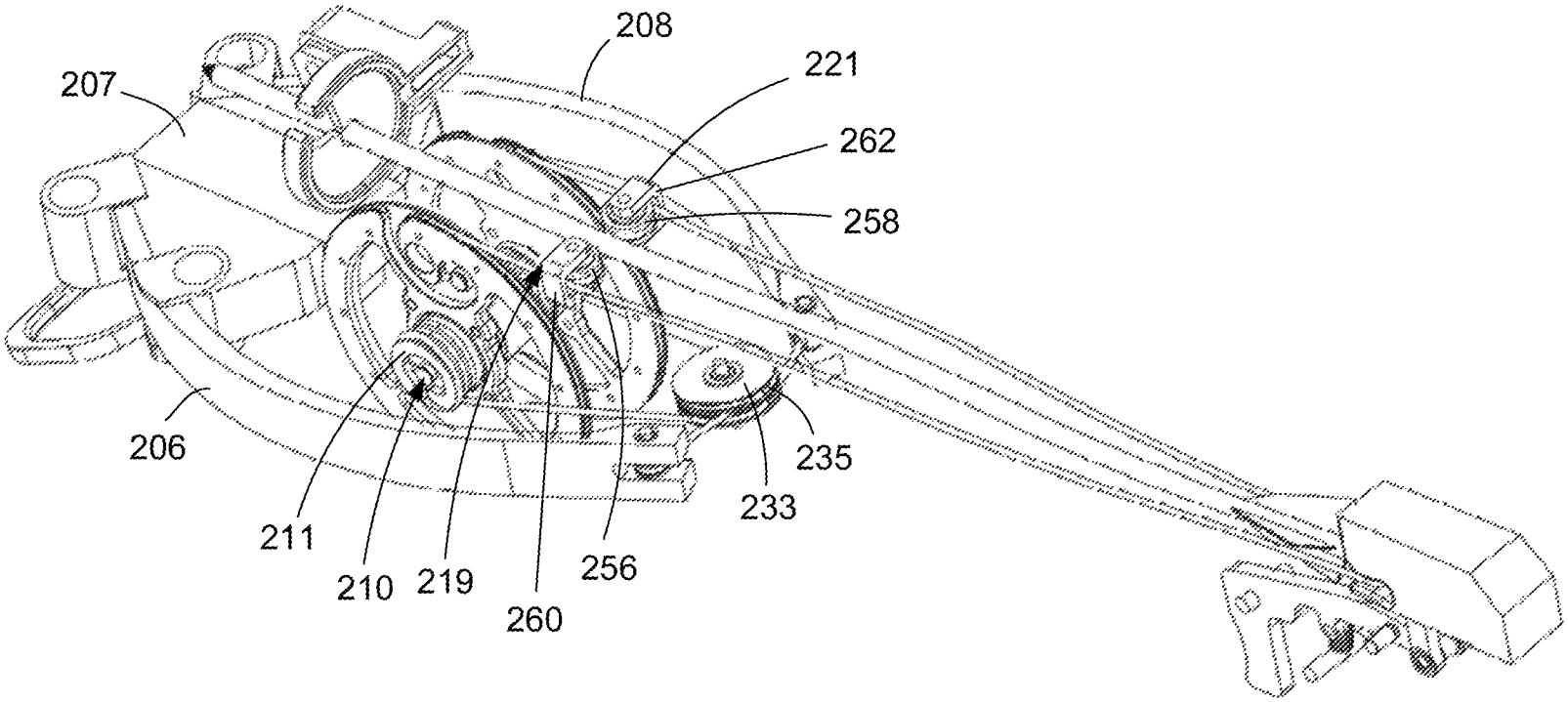
FIG. 19 is a left side perspective view of a portion of the crossbow of FIG. 18 in the drawn position.
Figure 20:
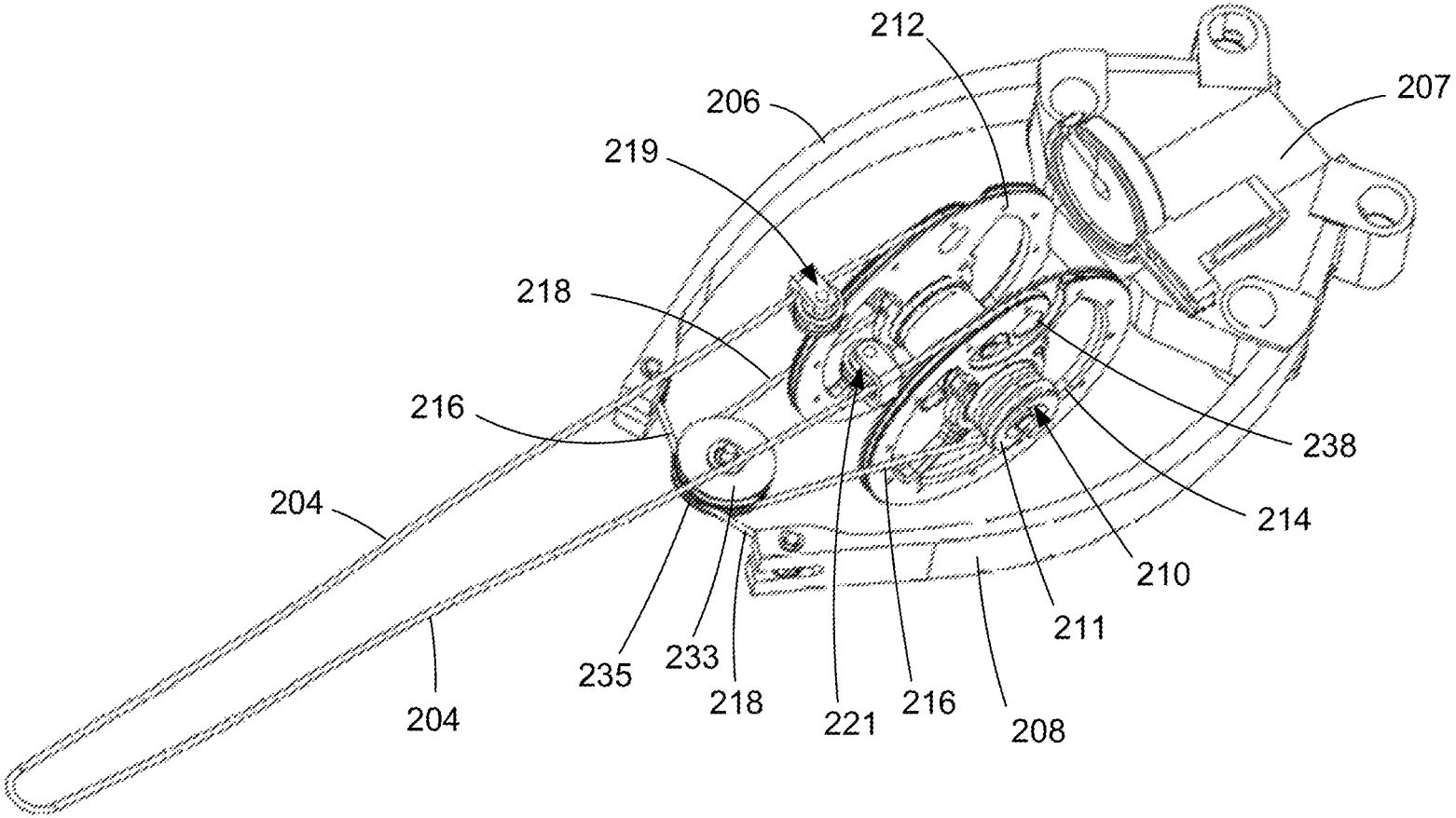
FIG. 20 is a right side perspective view the portion of the crossbow of FIG. 19 in the drawn position.
Figure 21:
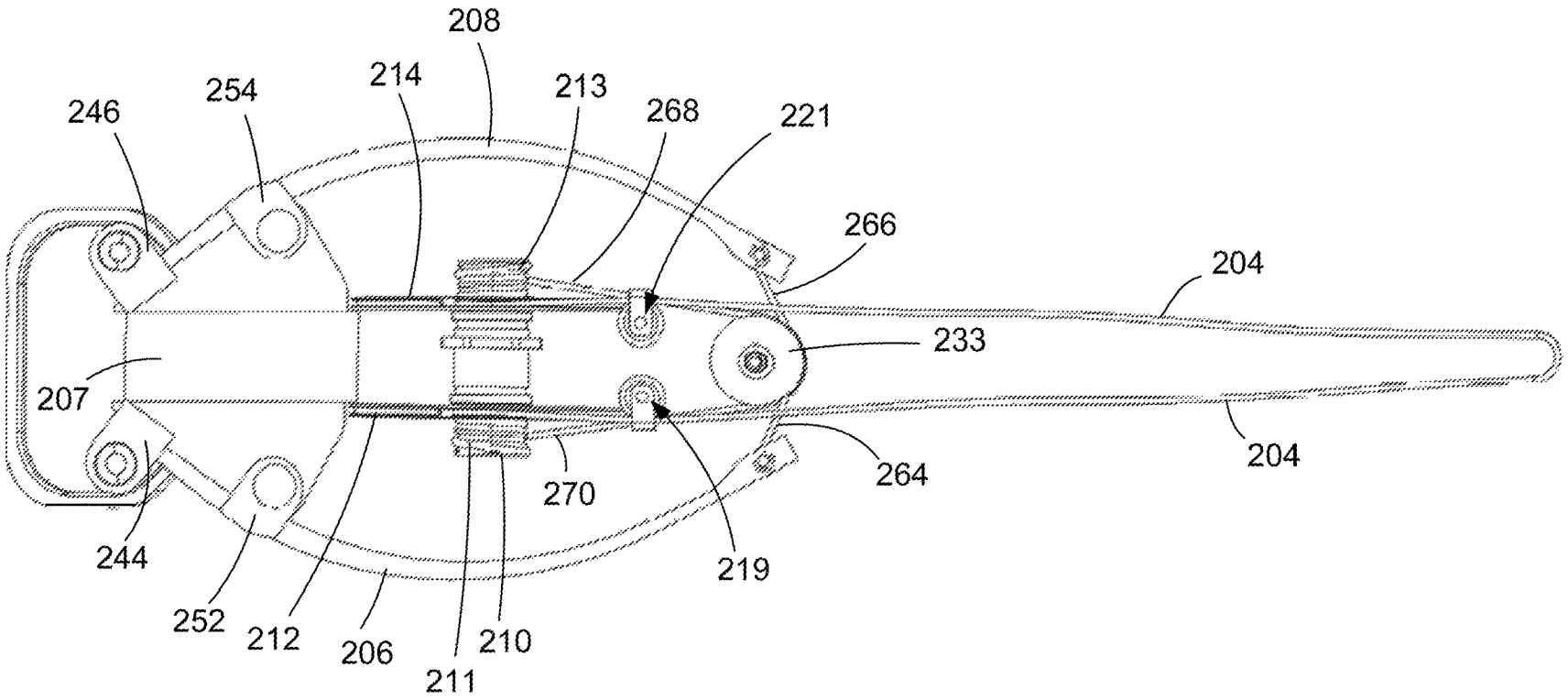
FIG. 21 is a top side view of the portion of the crossbow of FIG. 19 in the drawn position.
Figure 22:
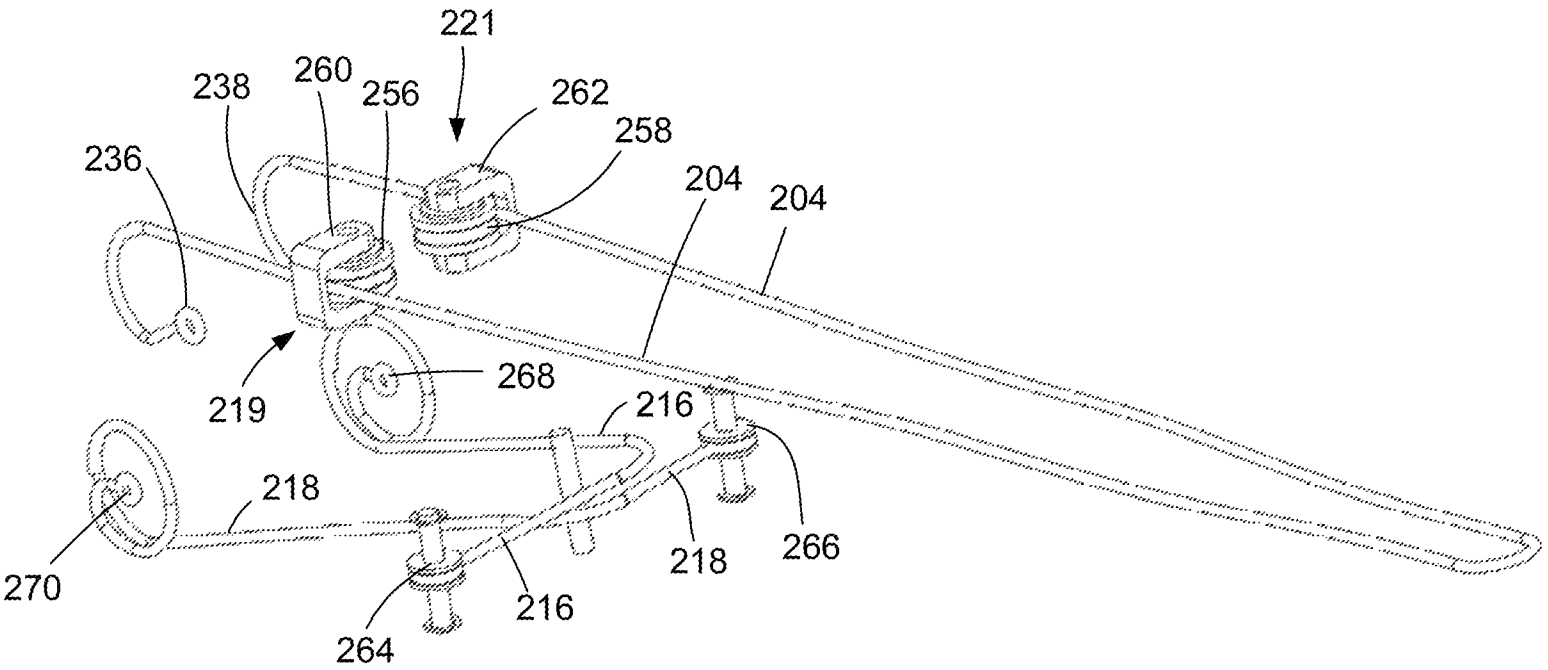
FIG. 22 is another left side perspective view of a portion of the crossbow of FIG. 18 in the drawn position.
Figure 23:
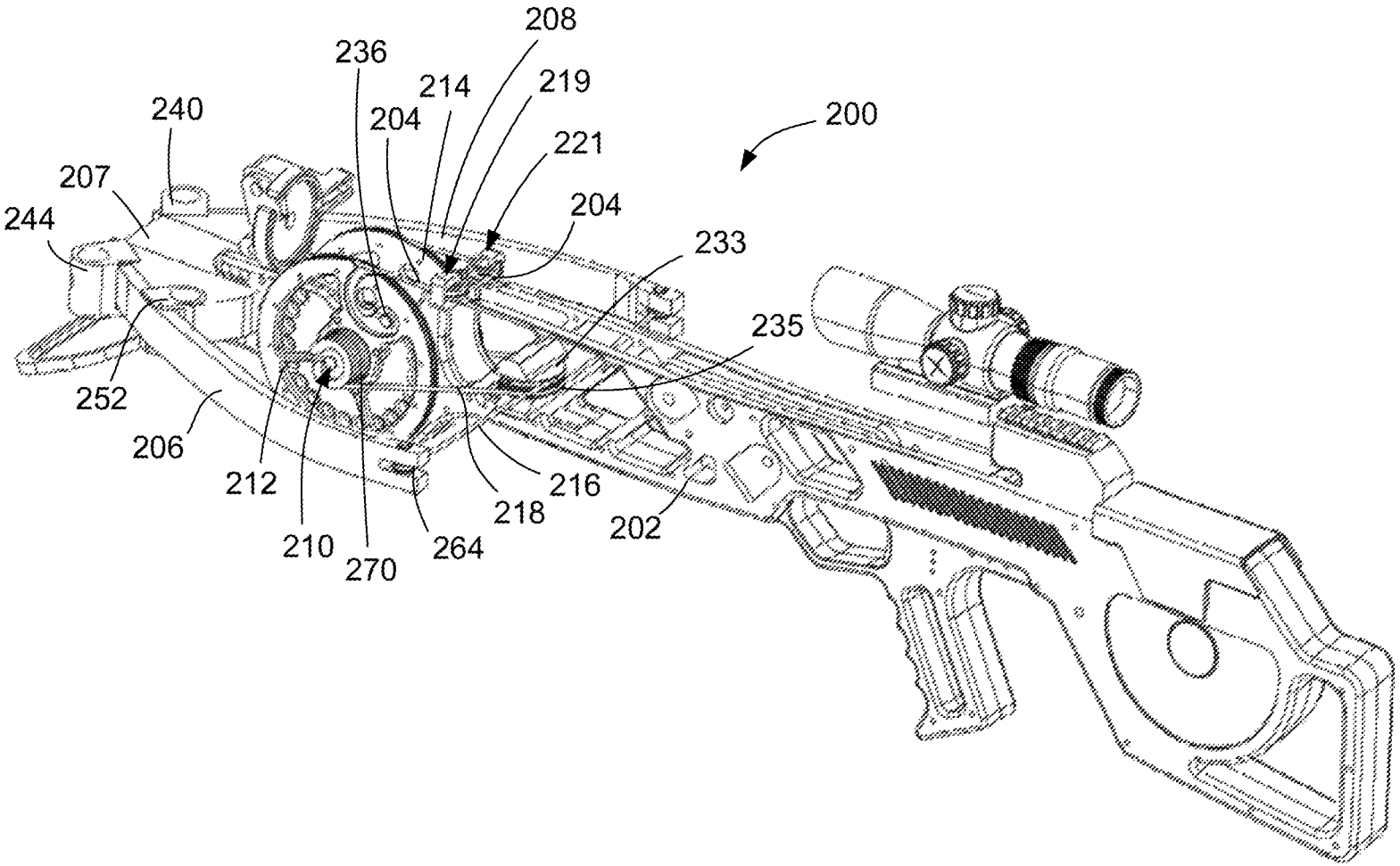
FIG. 23 is a left side perspective view of the crossbow of FIG. 18 in an undrawn position.
Figure 24:
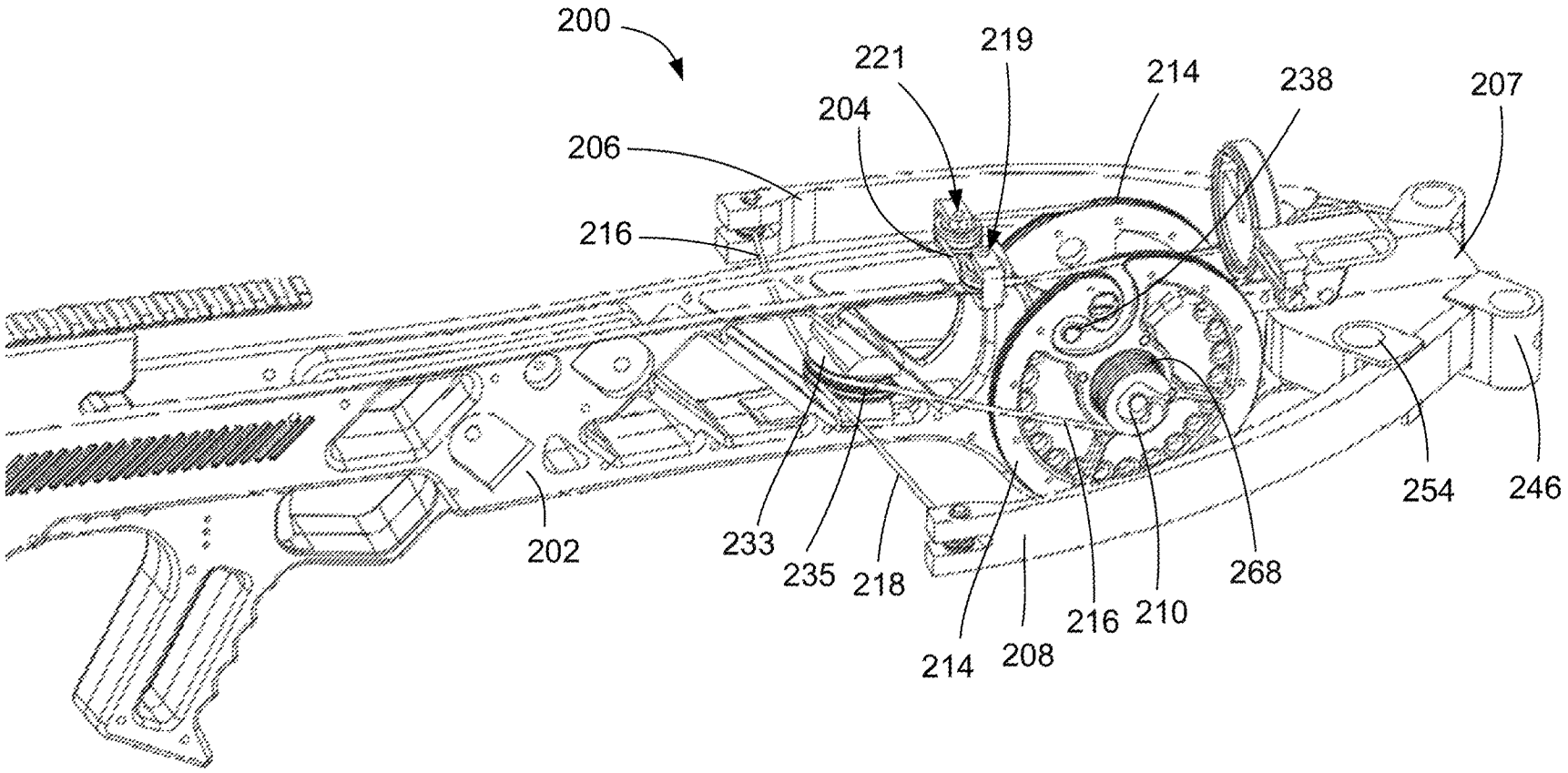
FIG. 24 is a right side perspective view the portion of the crossbow of FIG. 23 in the undrawn position.
Figure 25:
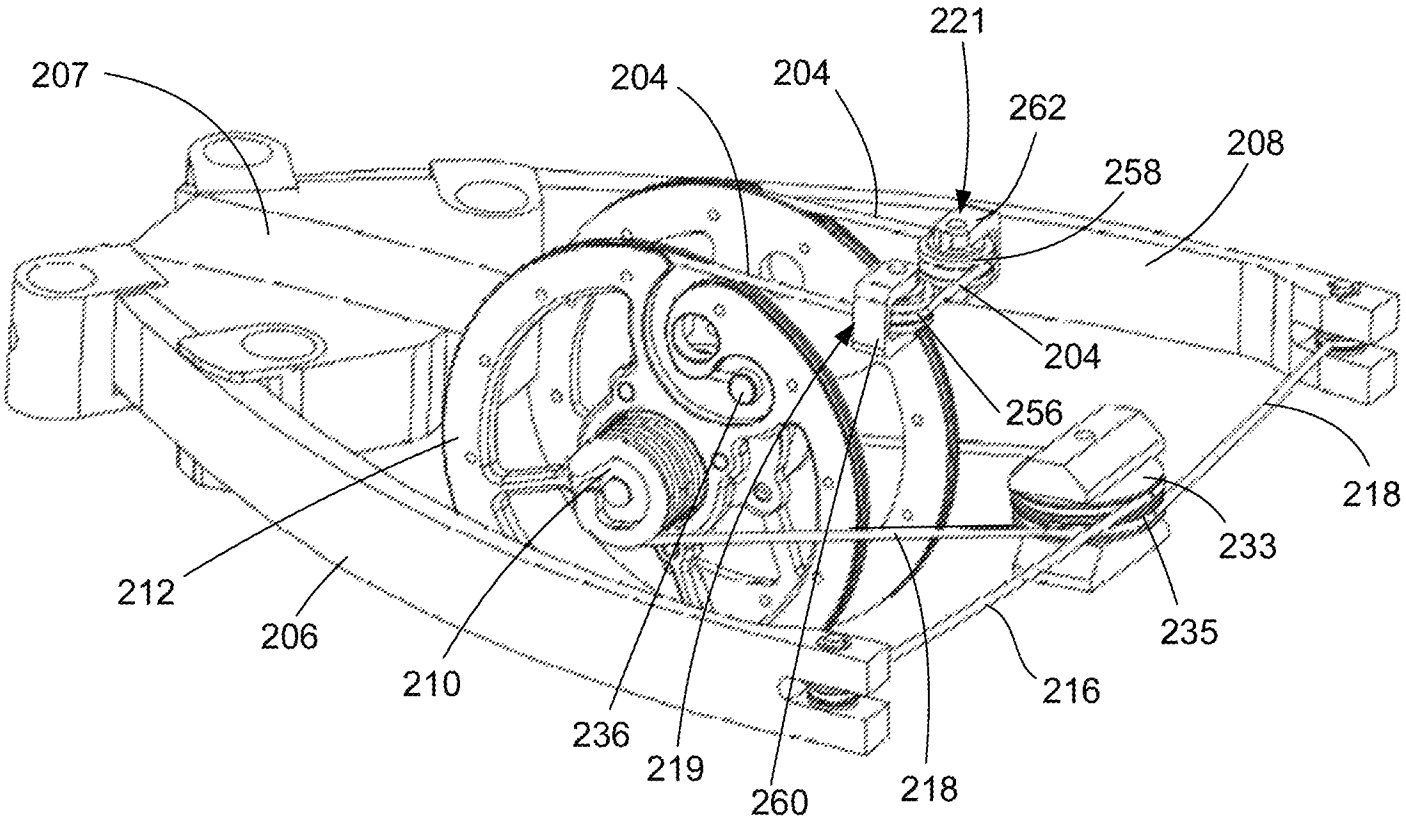
FIG. 25 is a left side perspective view of the portion of the crossbow of FIG. 23 in the drawn position.
Figure 26:
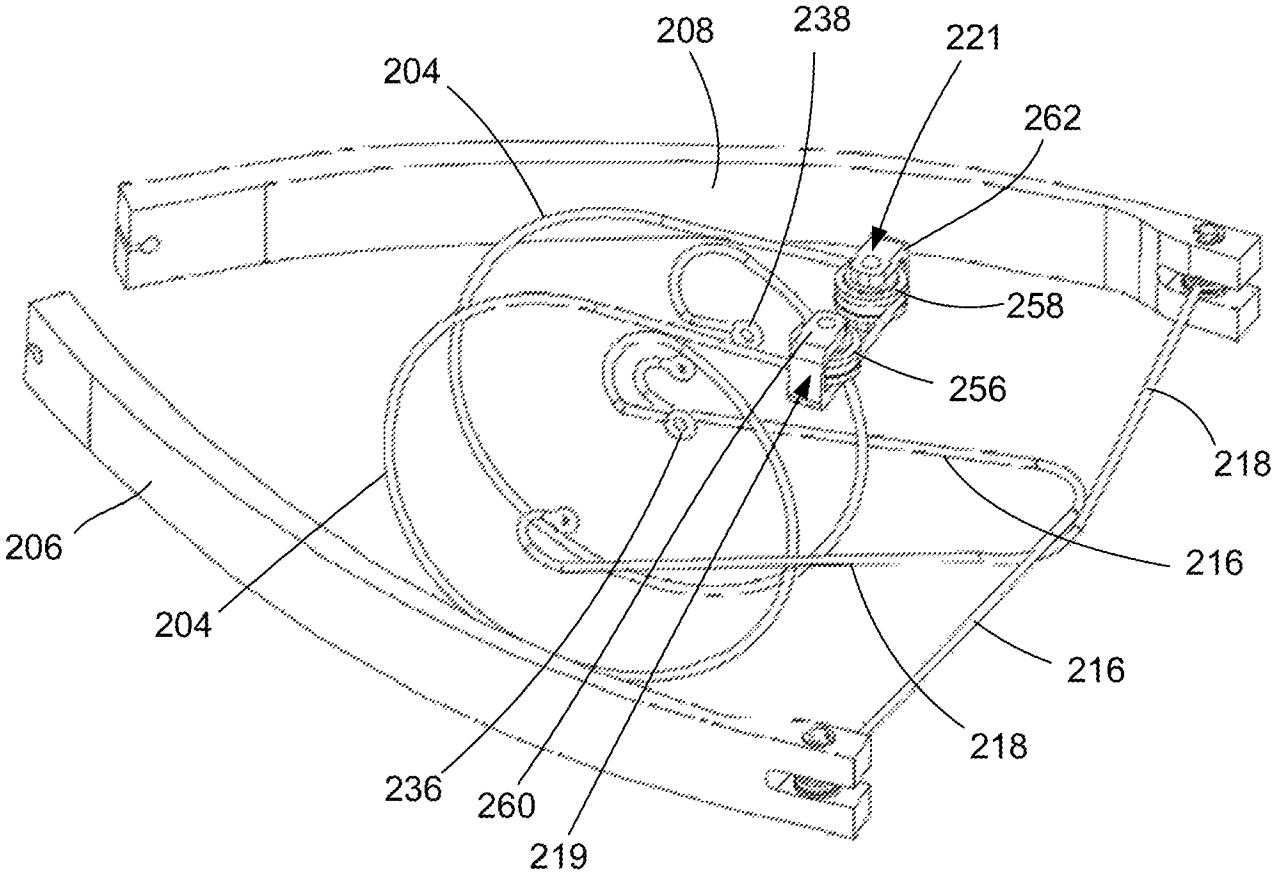
FIG. 26 is a left side perspective view of another portion of the crossbow of FIG. 18 in the drawn position.
Figure 27:
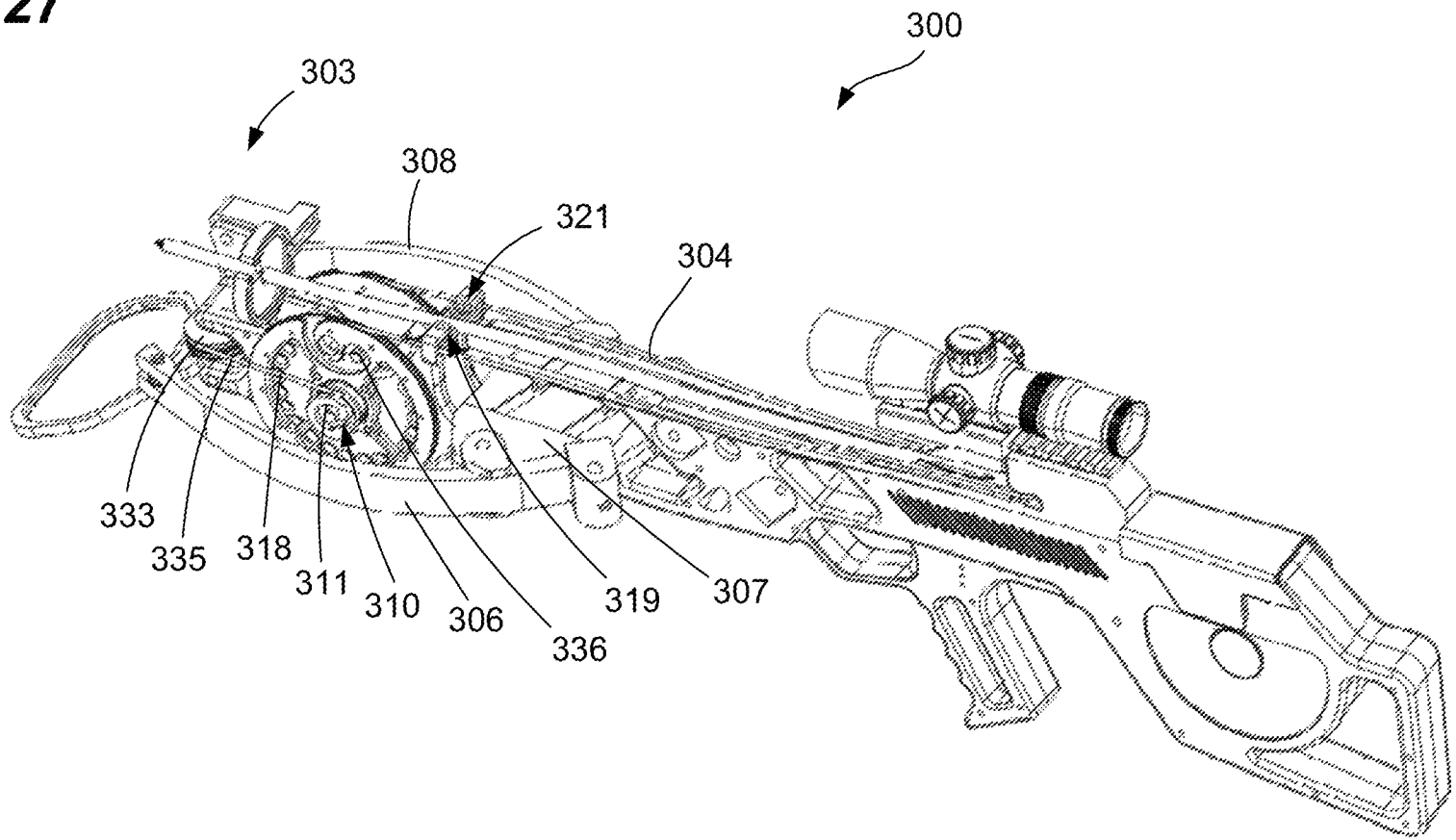
FIG. 27 is a left side perspective view of a crossbow according to the principles of the present disclosure; in particular
Figure 28:
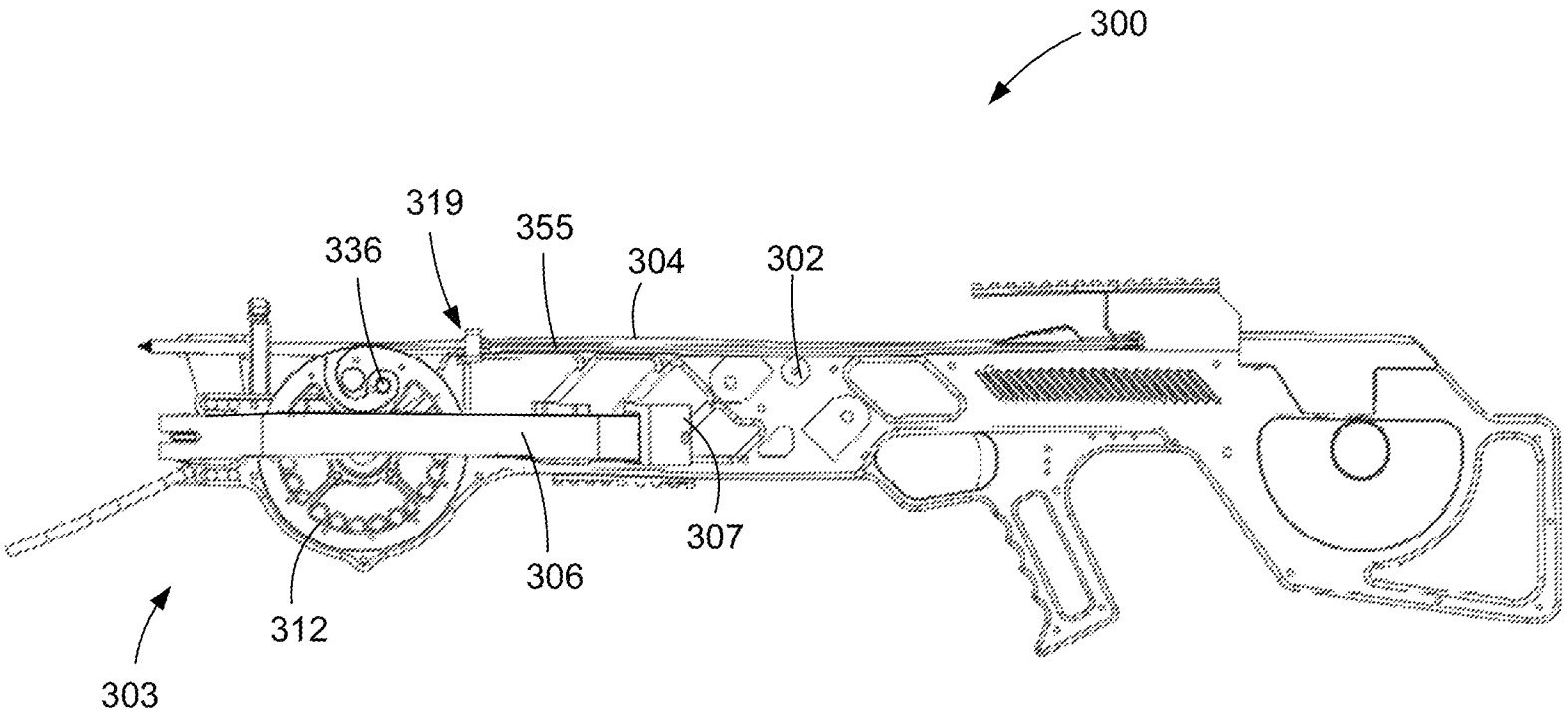
FIG. 28 is a left side view of the crossbow of FIG. 27 in the drawn position.
Figure 29:
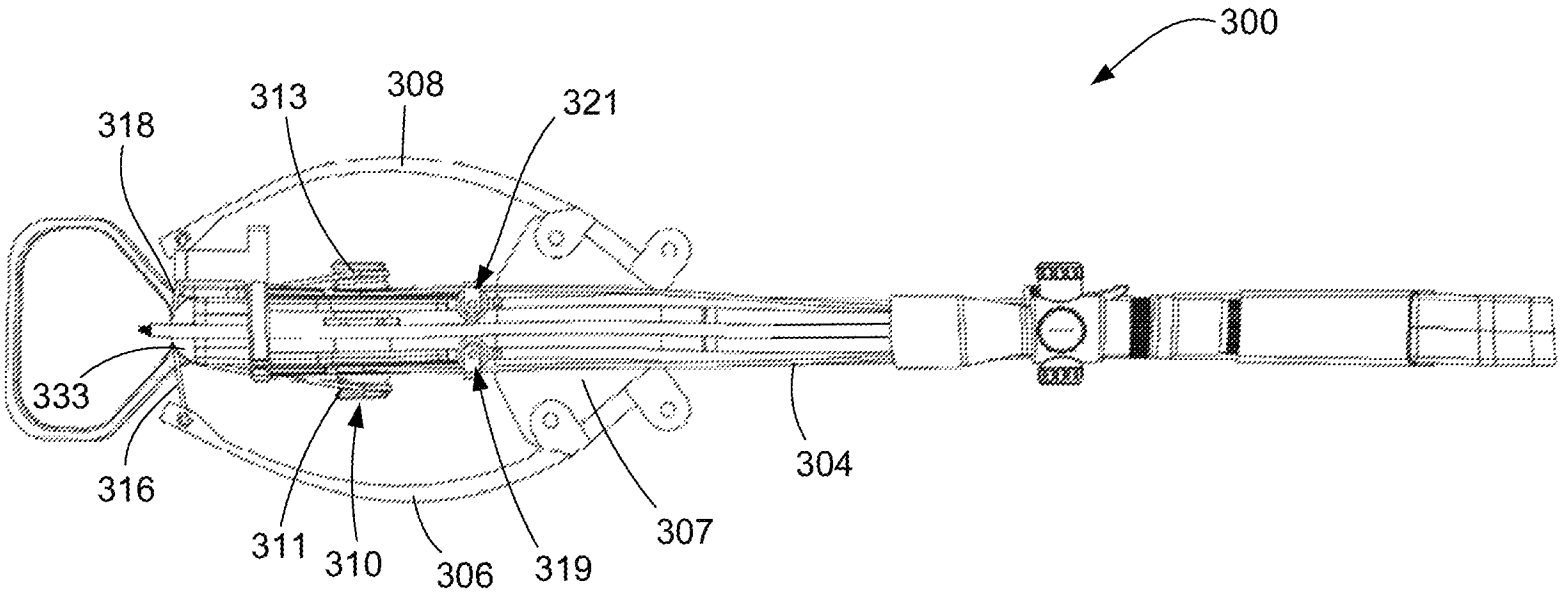
FIG. 29 is a top view of the crossbow of FIG. 27 in the drawn position.
Figure 30:
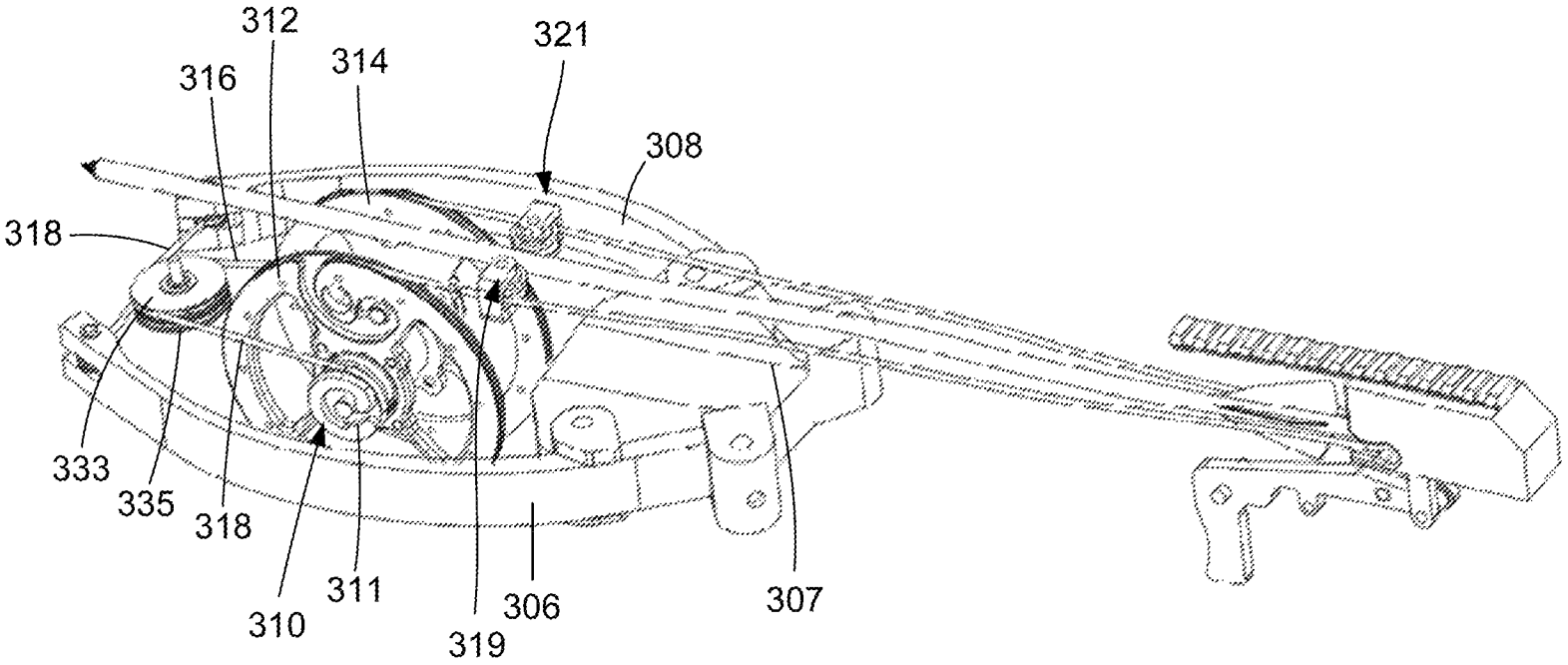
FIG. 30 is a left perspective view of a portion of the crossbow of FIG. 27 in the drawn position.
Figure 31:
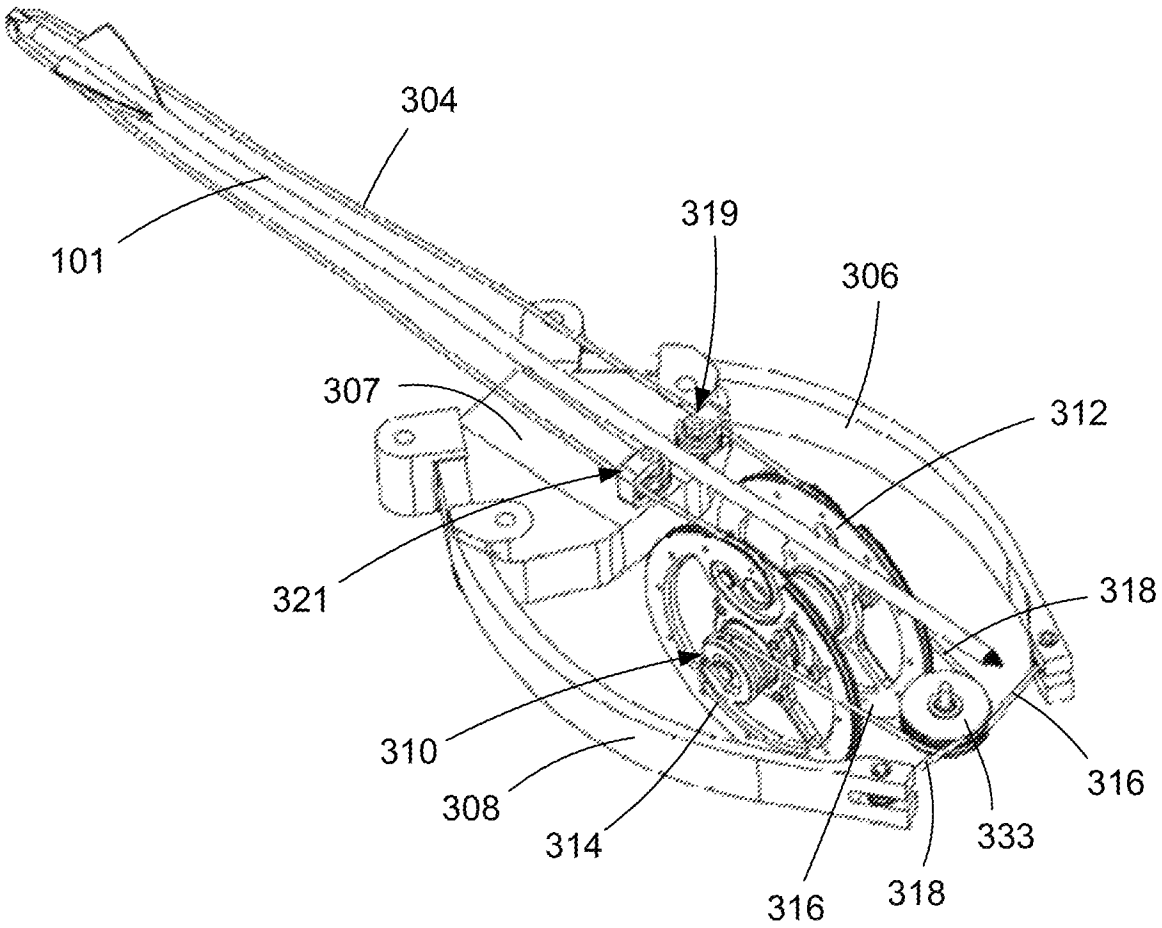
FIG. 31 is a right perspective view of a portion of the crossbow of FIG. 27 in the drawn position.
Figure 32:
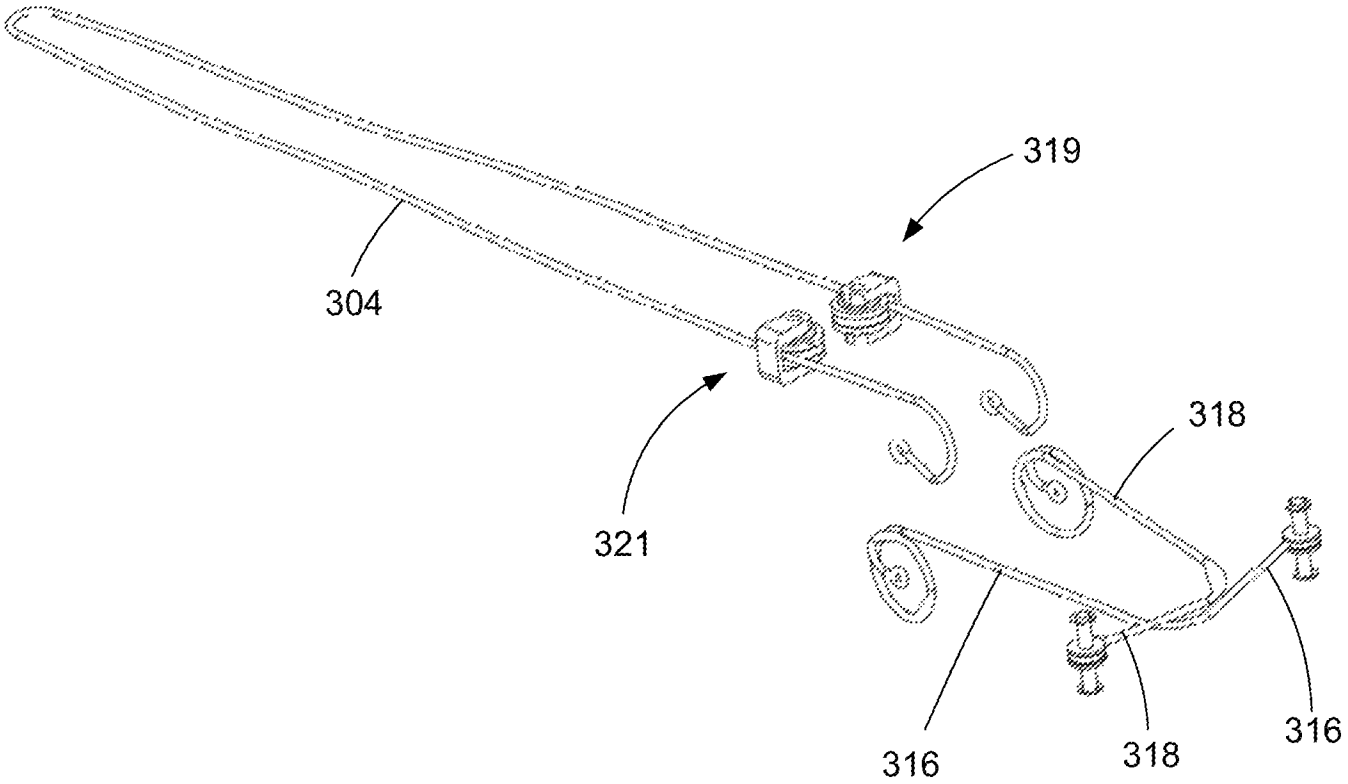
FIG. 32 is a right perspective view of a portion of the crossbow of FIG. 27 in the drawn position.
Figure 33:
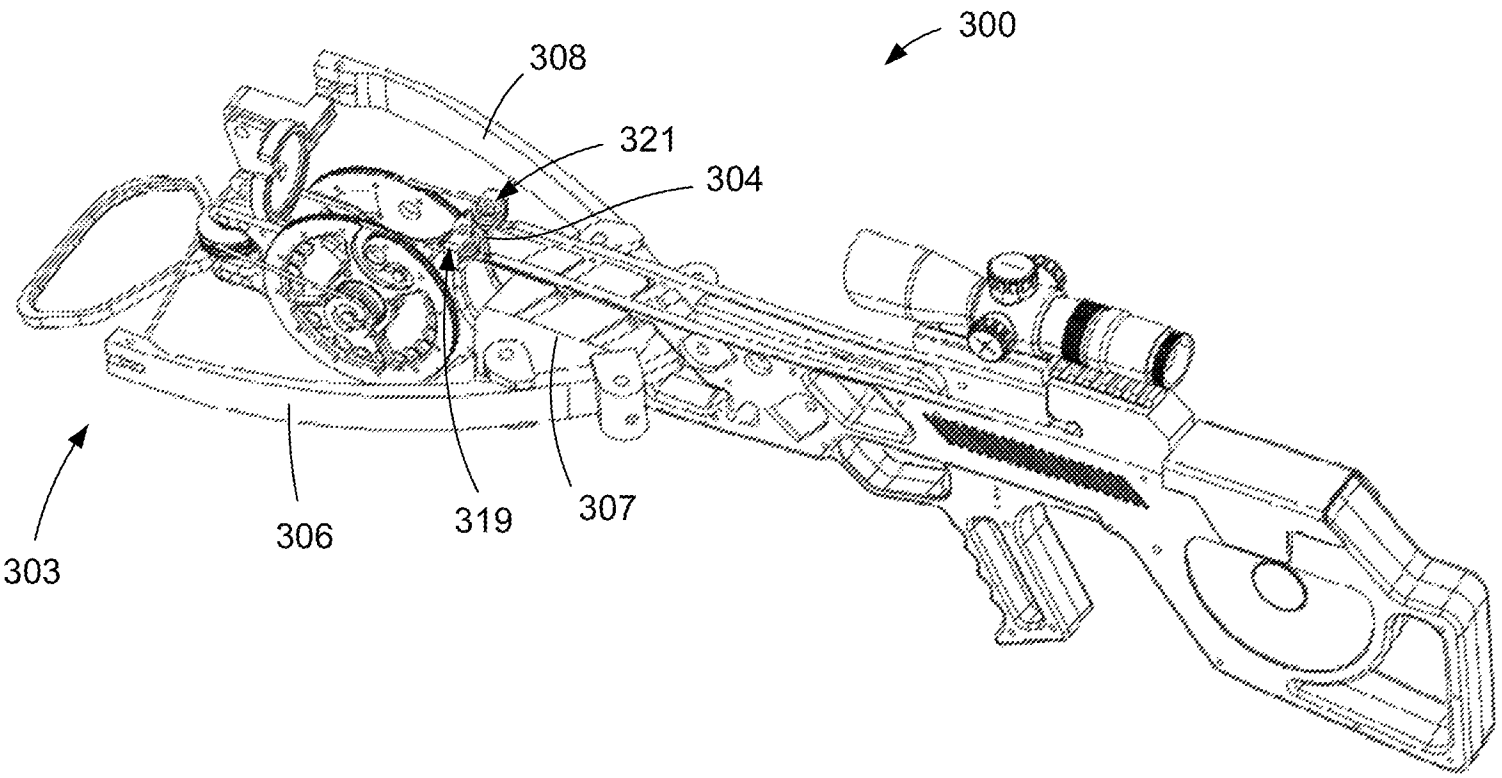
FIG. 33 is a left side perspective view of the crossbow of FIG. 27 in an undrawn position.
Figure 34:
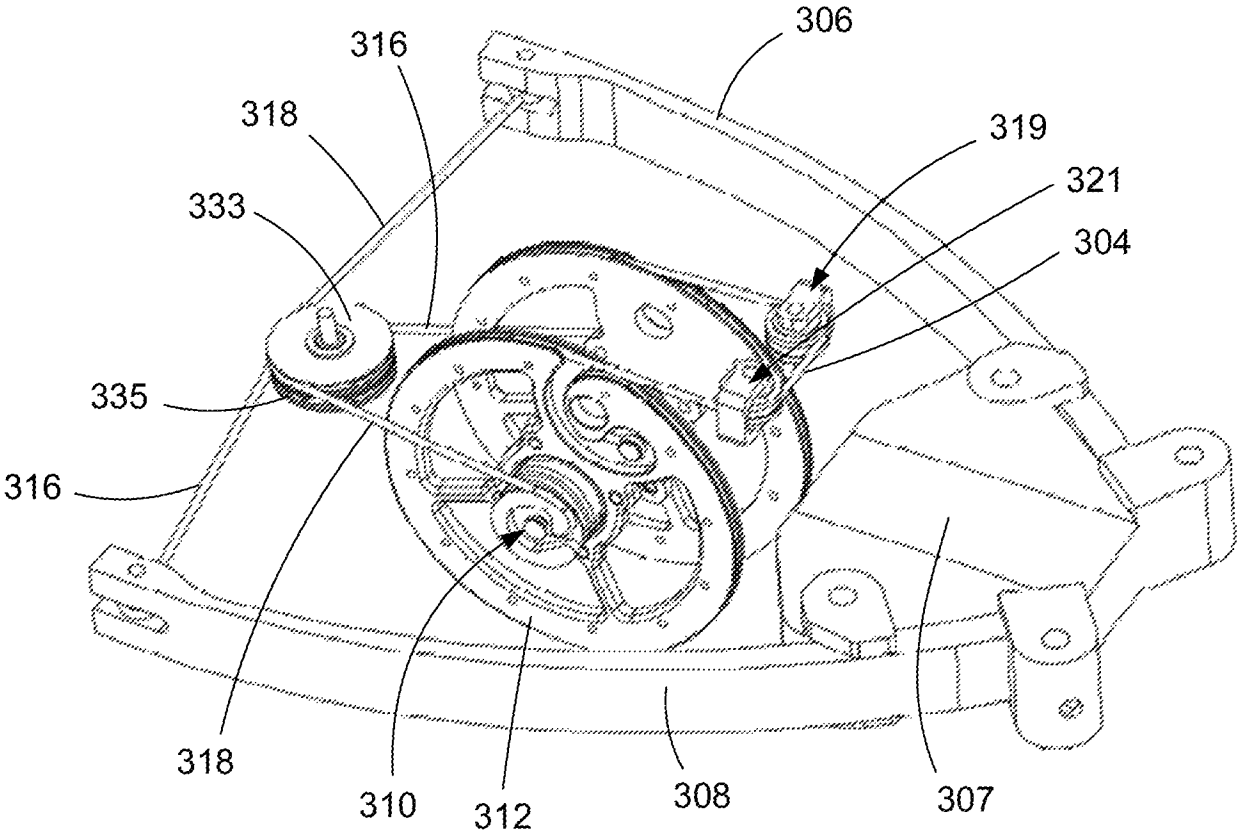
FIG. 34 is a right perspective view of a portion of the crossbow of FIG. 33 in the undrawn position.
Figure 35:
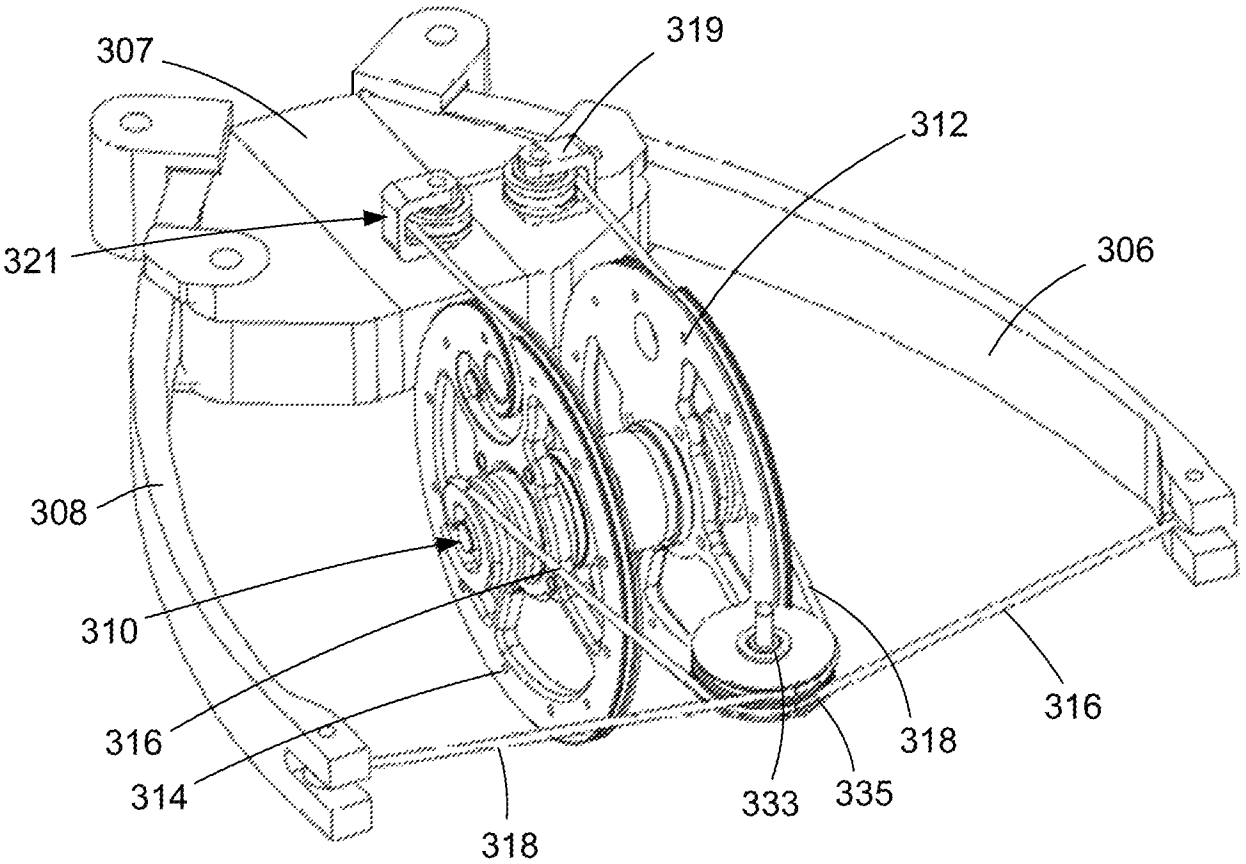
FIG. 35 is a front perspective view of the portion of the crossbow of FIG. 33 in the undrawn position.
Figure 36:
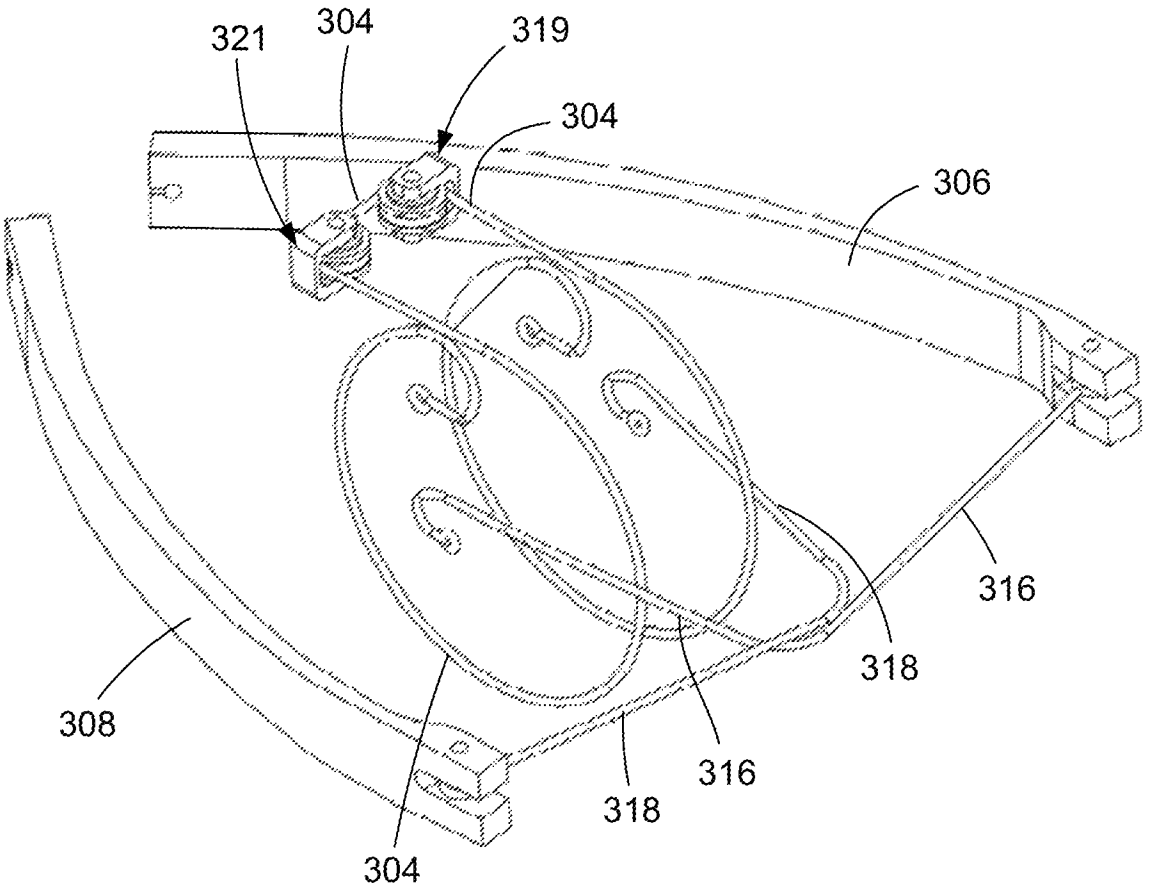
FIG. 36 is a right front perspective view of the portion of the crossbow of FIG. 33 in the undrawn position.

FIG. 10 shows a perspective view a portion of the crossbow 100 with the drawstring 104 drawn. As shown, the power cables 116, 118 include first ends 164, 166 and second ends 168, 170. The first ends 164, 166 are secured to the first and second drawstring wheels 111, 113 and the second ends 168, 170 are secured to the first and second limbs 106, 108. In some examples, the power cables 116, 118 can be wound around the first and second limbs 106, 108. As noted above, the first and second ends 136, 138 of the drawstring 104 are attached to the first and second power wheels 112, 114, respectively.

FIGS. 11-17 show the crossbow 100 with the drawstring 104 undrawn. When undrawn, the drawstring 104 remains biased and tensioned around the first and second drawstring guides 119, 121, thus ensuring a lack of slack of the drawstring 104. In some examples, the drawstring 104 is biased to resist arming or letting the drawstring unwind from the power wheels 112, 114 when the drawstring 104 is undrawn. This is due to the fact that the first and second limbs 106, 108 remain in partial tension when the drawstring 104 is undrawn. This partial tension applies a force to the power cables 116, 118 which in turn apply a force on the drawstring hub 110 to urge the drawstring hub 110 in the second direction R2. Such a force is transferred to the power wheels 112, 114 because the power wheels 112, 114 are attached to the drawstring hub 110 and rotate with the drawstring hub 110. Because the drawstring 104 has first and second ends 136, 138 attached to the first and second power wheels 112, 114, respectively, the drawstring 104 is pulled to the front end 103 of the frame 102 against the first and second drawstring guides 119, 121. The first and second drawstring guides 119, 121 guide the drawstring 104 across the top side 155 of the frame 102 and prevent the drawstring 104 from being further wound around the power wheels 112, 114. In some examples, when undrawn, the drawstring 104 is wrapped less than or equal to one time around the power wheels 112, 114.

A crossbow 200 is shown drawn in FIGS. 18-22, according to one example of the present disclosure. The crossbow 200 is substantially similar to the crossbow 100 discussed above. The crossbow 200 differs from crossbow 100 by having rearward facing parallel first and second limbs 206, 208.

The first and second limbs 206, 208 can either be a single limb or multiple limbs, as shown. In some examples, the limbs 206, 208 are elastic and spring-like in nature. The limbs 206 and 208 are attached to a frame 202 at a mount 207. In some examples, the limbs 206, 208 are also supported at mid supports 252, 254 between main supports 244, 246. In some examples, the mid supports 252, 254 are used as fulcrums to bend the limbs 206, 208 and the limbs 206, 208 are not attached to the mid supports 252, 254.

The first and second limbs 206, 208 are attached to power cables 216, 218. The power cables 216, 218 are then directed towards power cable guides 233, 235. In the depicted example, the power cable guides 233, 235 are independently rotatable stacked wheels mounted to frame 202. Like above, the power cables 216, 218 include first ends 264, 266 and second ends 268, 270. The first ends 264, 266 are secured to the first and second limbs 206, 208 and the second ends 268, 270 are secured to first and second drawstring wheels 211, 213 of a drawstring hub 210. In some examples, the power cables 216, 218 can be wound around the first and second limbs 206, 208. Like above, first and second ends 236, 238 of a drawstring 204 are attached to first and second power wheels 212, 214, respectively. When the drawstring 204 is drawn, first and second limbs 206, 208 are flexed by rotation of the drawstring hub 110, and therefore by rotation of the power wheels 212, 214.

First and second drawstring guides 219, 221, which are substantially similar to the first and second drawstring guides 119, 121 described above, are attached to the frame 202 and each guide guides the drawstring 204 across the projectile axis A between the first and second ends 236, 238 of the drawstring 204. The first and second drawstring guides 219, 221 each include a pulley wheel 256, 258 mounted to a frame 260, 262.

FIGS. 23-26 depict the crossbow 200 with the drawstring 204 undrawn. When undrawn, the drawstring 204 remains biased and tensioned around the first and second drawstring guides 219, 221, thus ensuring a lack of slack of the drawstring 204.

A crossbow 300 is shown drawn in FIGS. 27-32, according to one example of the present disclosure. The crossbow 300 is substantially similar to the crossbows 100, 200 discussed above. The crossbow 300 differs from crossbows 100, 200 by having forward facing parallel first and second limbs 306, 308. First and second limbs 306 and 308 are attached to a frame 302 at a mount 307 and, when a drawstring 304 is drawn, first and second limbs 306, 308 are flexed by rotation of a drawstring hub 310 and therefore the power wheels 312, 314. Like above, first and second ends 336, 338 of the drawstring 304 are attached to first and second power wheels 312, 314, respectively. The first and second limbs 306, 308 are attached to power cables 316, 318 and the power cables 316, 318 are then directed toward power cable guides 333, 335. The power cables 316, 318 are secured to the first and second limbs 306, 308 and to first and second drawstring wheels 311, 313 of the drawstring hub 310. First and second drawstring guides 319, 321, which are substantially similar to the first and second drawstring guides 119, 219/219, 221 described above, are attached to the frame 302 and each guide guides the drawstring 304.

The power cable guides 333, 335 are positioned nearer a front end 303 of the frame 302 than the mount 307. In the depicted examples of FIG. 28, the mount 307 is connected to the frame 302 below a top side 355.

FIGS. 33-36 depict the crossbow 300 with the drawstring 304 undrawn. When undrawn, the drawstring 304 remains biased and tensioned around the first and second drawstring guides 319, 321, thus ensuring a lack of slack of the drawstring 304.

Figure 37:
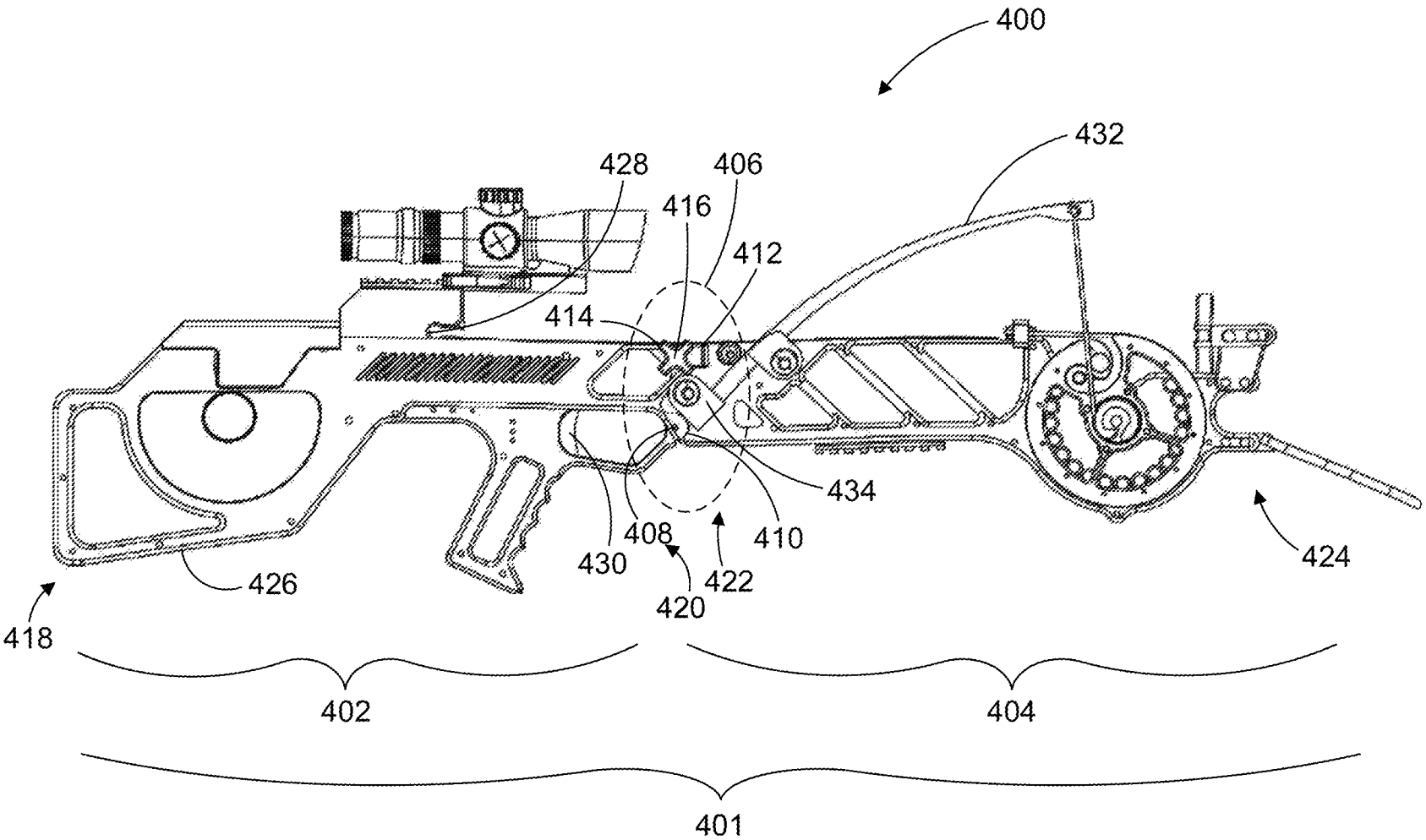
FIG. 37 is a right side view of a crossbow according to the principles of the present disclosure; in particular
Figure 38:
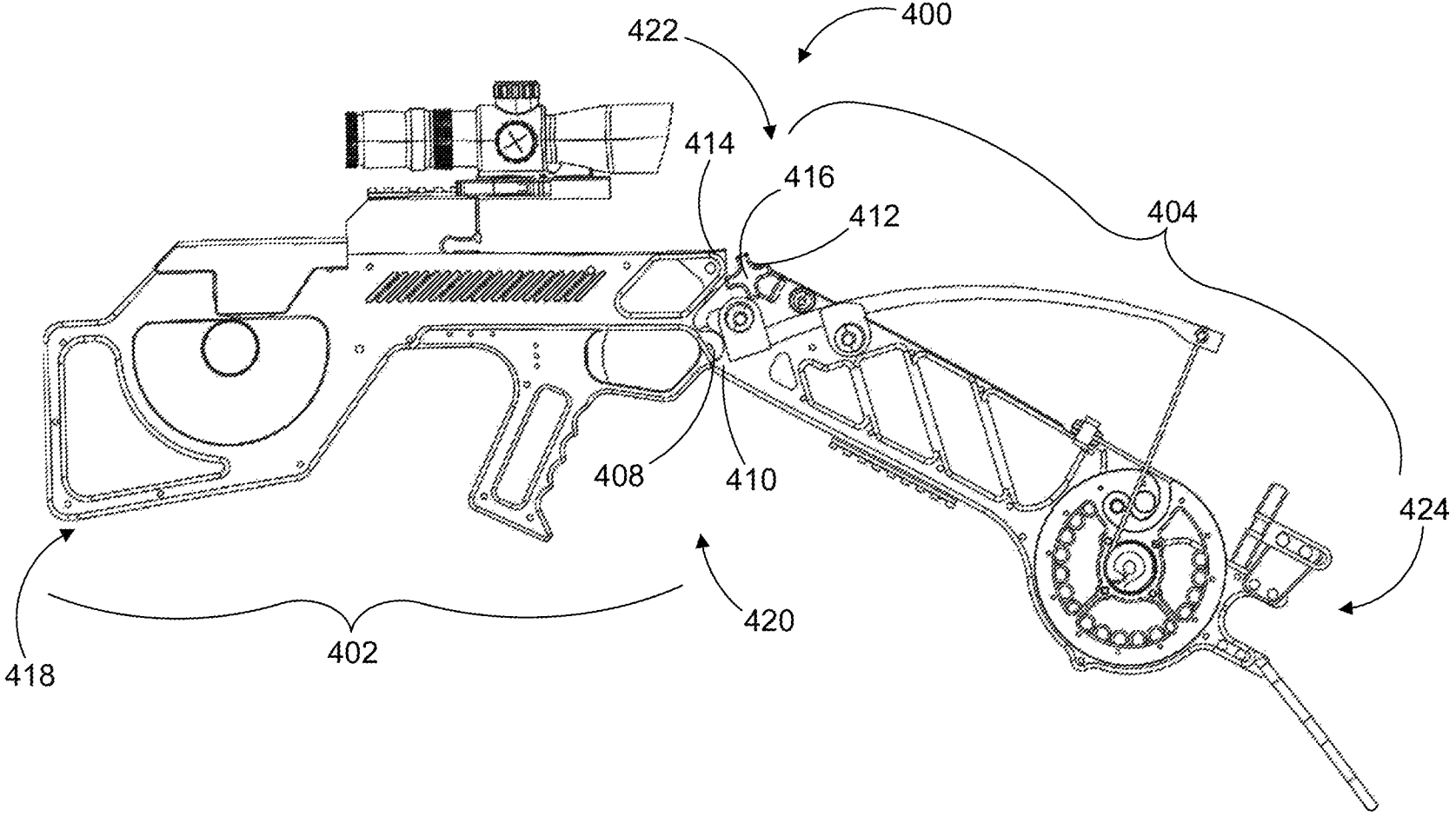
FIG. 38 is a right side view of the crossbow of FIG. 37 partially disassembled and in an undrawn position.
Figure 39:
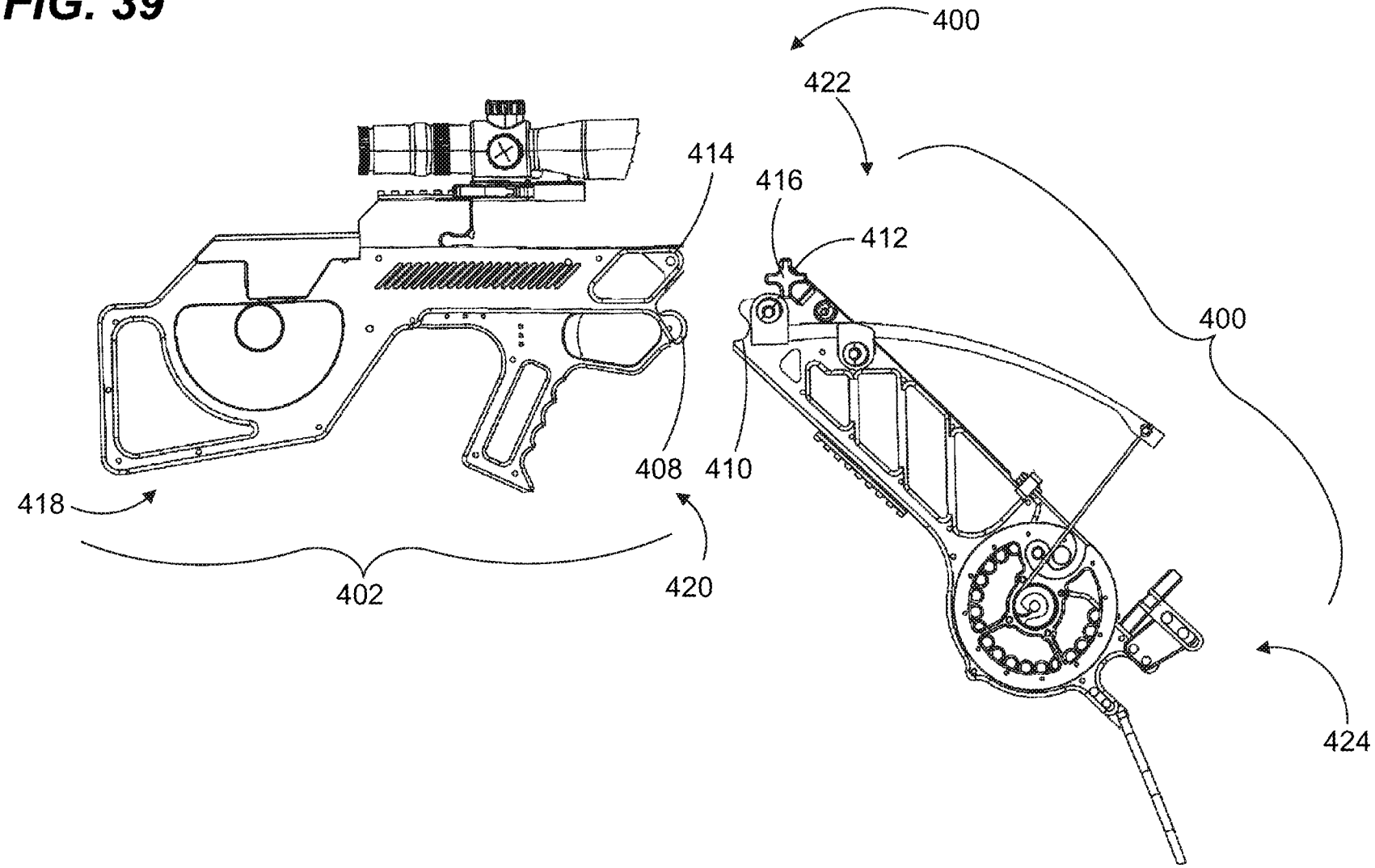
FIG. 39 is a right side view of the crossbow of FIG. 37 disassembled and in an undrawn position.

A crossbow 400 is shown drawn in FIGS. 37-45, according to one example of the present disclosure. The crossbow 400 is substantially similar to the crossbow 100 discussed above. The crossbow 400 differs from crossbow 100 by having a frame 401 comprised of a first frame portion 402 and a second frame portion 404 that are detachably coupled to one another via a fastening mechanism 406 to enable disassembly of the crossbow 400 when not in use. FIG. 37 is a right side view of the crossbow 400 assembled and in an undrawn position. FIG. 38 is a right side view of the crossbow 400 partially disassembled and in an undrawn position. FIG. 39 is a right side view of the crossbow 400 disassembled and in an undrawn position.

The fastening mechanism 406 can be any type of mechanism capable of repeatedly enabling detachment and secure re-attachment of the two frame portions 402, 404. In some examples, the fastening mechanism 406 can be a dovetail joint or a sliding joint. In other examples, the fastening mechanism 406 can be a pivot lock joint as shown in FIGS. 37-45. For example, the fastening mechanism 406 includes a male pivot 408 and a female pivot 410, as well as a male lock 412, a female lock 414, and a lock knob bolt 416. Positions at which the frame portions 402, 404 attach and detach from one another via the fastening mechanism 406 are selected to prevent disruption or interference with the mechanical assemblies of the crossbow 400 when the crossbow 400 is disassembled.

The first frame portion 402 is a rearward portion of the frame 401 comprising a first end 418 and a second end 420. The first end 418 of the first frame portion 402 is at a furthest rearward position of the frame 401 (e.g., a rear end of the frame 401) and includes a stock 426. The second end 420 of the first frame portion 402 includes the male pivot 408 and the female lock 414 of the fastening mechanism 406. The second end 420 of the first frame portion 402 is positioned forward from a latch 428 and a trigger assembly 430 of the crossbow 400. As previously discussed, the latch 428 and the trigger assembly 430 are in communication so that upon activation of the trigger assembly 430 when firing (e.g., pulling the trigger toward the rear end of the frame 401) the trigger assembly 430 moves the latch 428 causing a drawstring held by the latch 428 to be released and free to travel toward the front end of the frame 401. Thus, by positioning the second end 420 of the first frame portion 402 forward from the latch 428 and the trigger assembly 430, the communication between the latch 428 and the trigger assembly 430 and their associated mechanical assemblies are not disrupted or otherwise interfered with when the crossbow 400 is disassembled by detaching the first frame portion 402 from the second frame portion 404.

The second frame portion 404 is a forward portion of the frame 401 comprising a first end 422 and a second end 424. The first end 422 of the second frame portion 404 includes the female pivot 410 and the male lock 412 of the fastening mechanism 406. The first end 422 of the second frame portion 404 is positioned rearward from a location on the frame 401 where the limbs 432 of the crossbow 400 attach to the frame 401. In some examples, the main supports 434 that attach the limbs 432 to the frame 401 can be located proximate to the female pivot 410 and male lock 412 at the first end 422 of the second frame portion 404. The second end 424 of the second frame portion 404 is at a furthest forward position of the frame 401 (e.g., a front end of the frame 401). By positioning the first end 422 of the second frame portion 404 rearward from where the limbs 432 attach to the frame 401, and thus also rearward from other components, such as the drawstring hub, drawstring wheels, power wheels, power cables, and drawstring guides discussed with reference to crossbow 100, these components and their associated mechanical assemblies are not disrupted or otherwise interfered with when the crossbow 400 is disassembled by detaching the first frame portion 402 from the second frame portion 404. For example, the second frame portion 404 remains in an undrawn position and fully preloaded when disassembled from the first frame portion 402.

As shown in FIG. 37, when the crossbow 400 is in an assembled and undrawn position: the male pivot 408 on the second end 420 of the first frame portion 402 is mated with the female pivot 410 on the first end 422 of the second frame portion 404; the female lock 414 on the second end 420 of the first frame portion 402 is mated with the male lock 412 on the first end 422 of the second frame portion 404; and the lock knob bolt 416 is inserted through aligned apertures of the mated female lock 414 and male lock 412 and threaded or otherwise locked to secure the first frame portion 402 to the second frame portion 404.

To disassemble the crossbow 400 in an undrawn position, the lock knob bolt 416 416 is unthreaded or otherwise unlocked and removed from apertures of the mated female lock 414 and male lock 412. The mate alignment between the female lock 414 and male lock 412 is then broken by providing a downward force on the second frame portion 404 leaving the crossbow 400 partially disassembled, as shown in FIG. 38. The downward force can include a passive, gravitational force. Additionally, the downward force can include an active application of force. For example, a user of the crossbow 400 can stabilize the first frame portion 402 as the user applies a downward force to the second frame portion 404 to break the mate alignment between the female lock 414 and male lock 412.

To fully disassemble the crossbow 400 in the undrawn position, continued downward force can be provided to the second frame portion 404 to break the mate alignment between the female pivot 410 and the male pivot 408. For example, the user of the crossbow 400 can continue to stabilize the first frame portion 402 as the user provides a further downward force to the second frame portion 404 to break the mate alignment between the female pivot 410 and the male pivot 408. Once both mate alignments are broken, the first frame portion 402 and the second frame portion 404 are completely detached from one another and the crossbow 400 is disassembled, as shown in FIG. 39. In some examples, after the crossbow 400 is partially disassembled as shown in FIG. 38 or disassembled as shown in FIG. 39, the lock knob bolt 416 may then be inserted through the apertures of the male lock 412 and secured or otherwise locked on the first end 422 of the second frame portion 404 to prevent the lock knob bolt 416 from being lost as the disassembled crossbow 400 is being transported and/or stored, for example.

Figure 40:
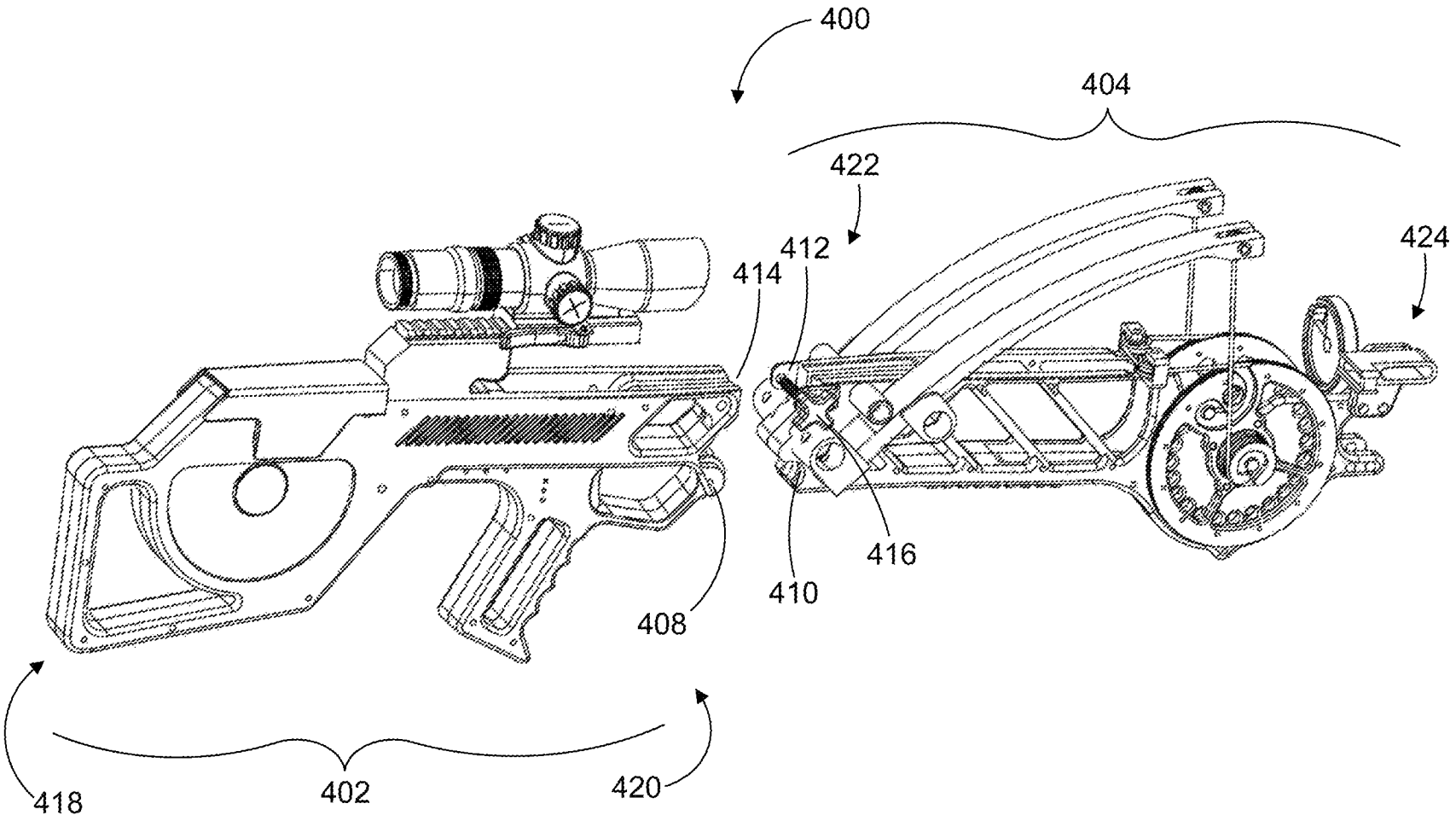
FIG. 40 is a right side perspective view of the disassembled crossbow of FIG. 39.
Figure 41:
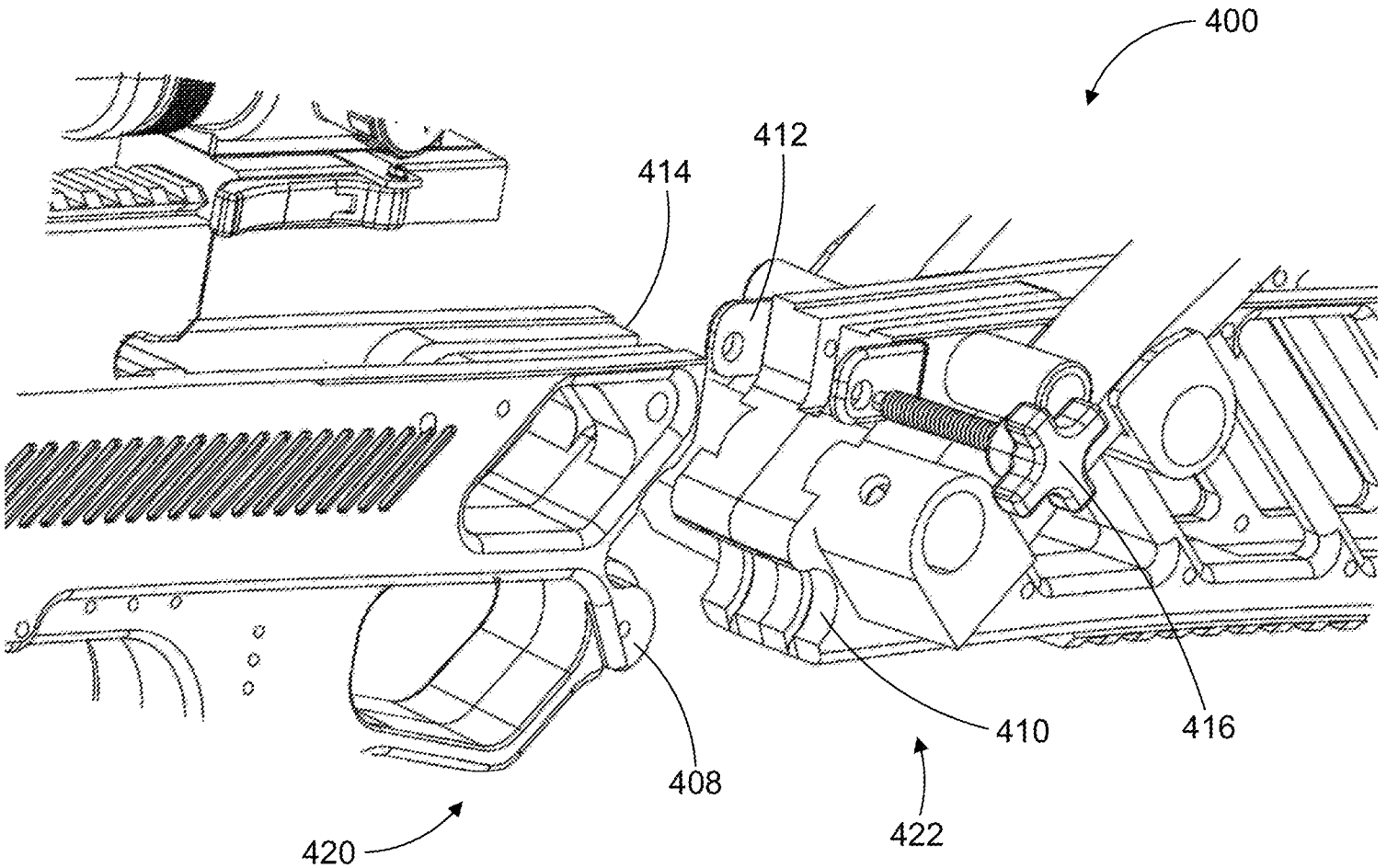
FIG. 41 is a right side perspective view of a portion of the disassembled crossbow of FIG. 39.
Figure 42:
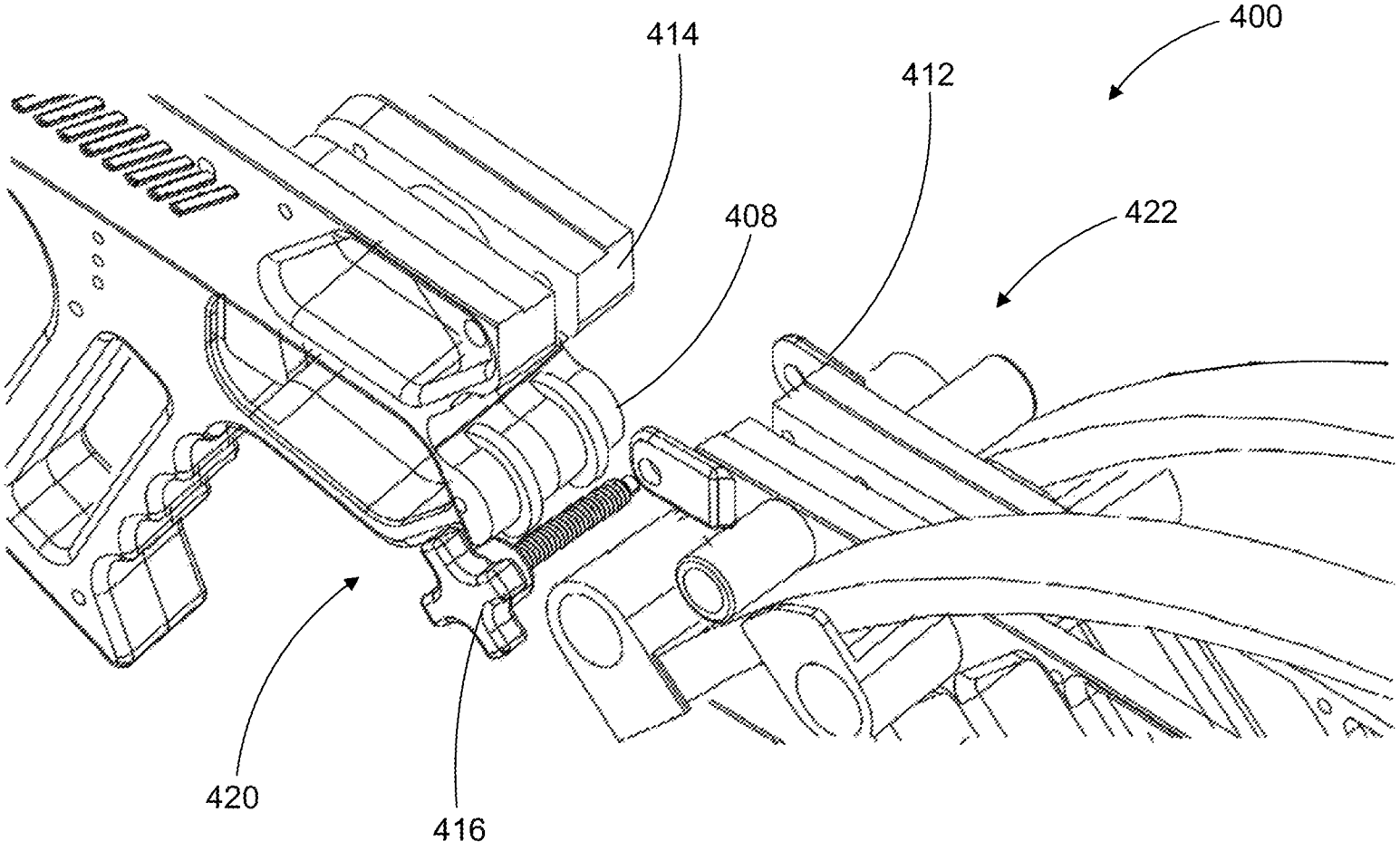
FIG. 42 is right side perspective view of another portion of the disassembled crossbow of FIG. 39.
Figure 43:
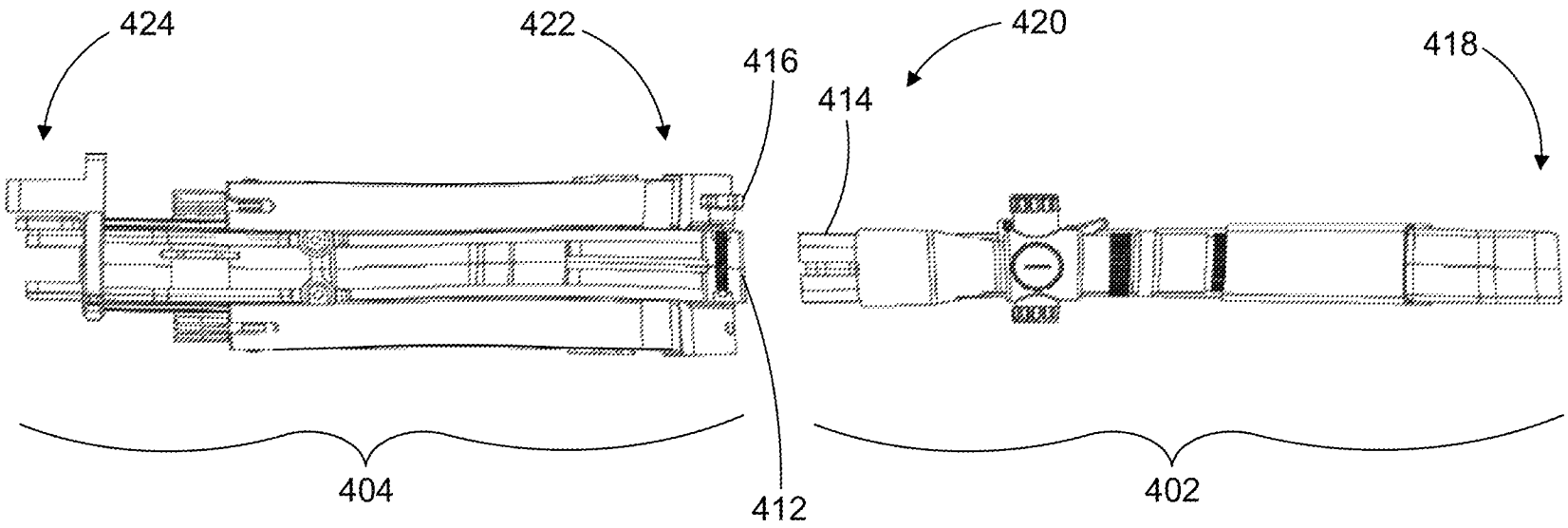
FIG. 43 is a top view of the disassembled crossbow of FIG. 39.

FIGS. 40-43 provide additional views of the disassembled crossbow 400 of FIG. 39. FIG. 40 is a right side perspective view of the disassembled crossbow 400 of FIG. 39. FIG. 41 is a right side perspective view of a portion of the disassembled crossbow of FIG. 39. The portion includes the second end 420 of the first frame portion 402 and the first end 422 of the second frame portion 404, with a focus on the fastening mechanism components of the first end 422 of the second frame portion 404. FIG. 42 is right side perspective view of another portion of the disassembled crossbow of FIG. 39. This other portion includes the second end 420 of the first frame portion 402 and the first end 422 of the second frame portion 404, with a focus on the fastening mechanism components of the second end 420 of the first frame portion 402. FIG. 43 is a top view of the disassembled crossbow 400 of FIG. 39 that emphasizes the narrow design of the crossbow 400 and the further compactness that can be achieved by disassembling into the two frame portions 402, 404.

Figure 44:
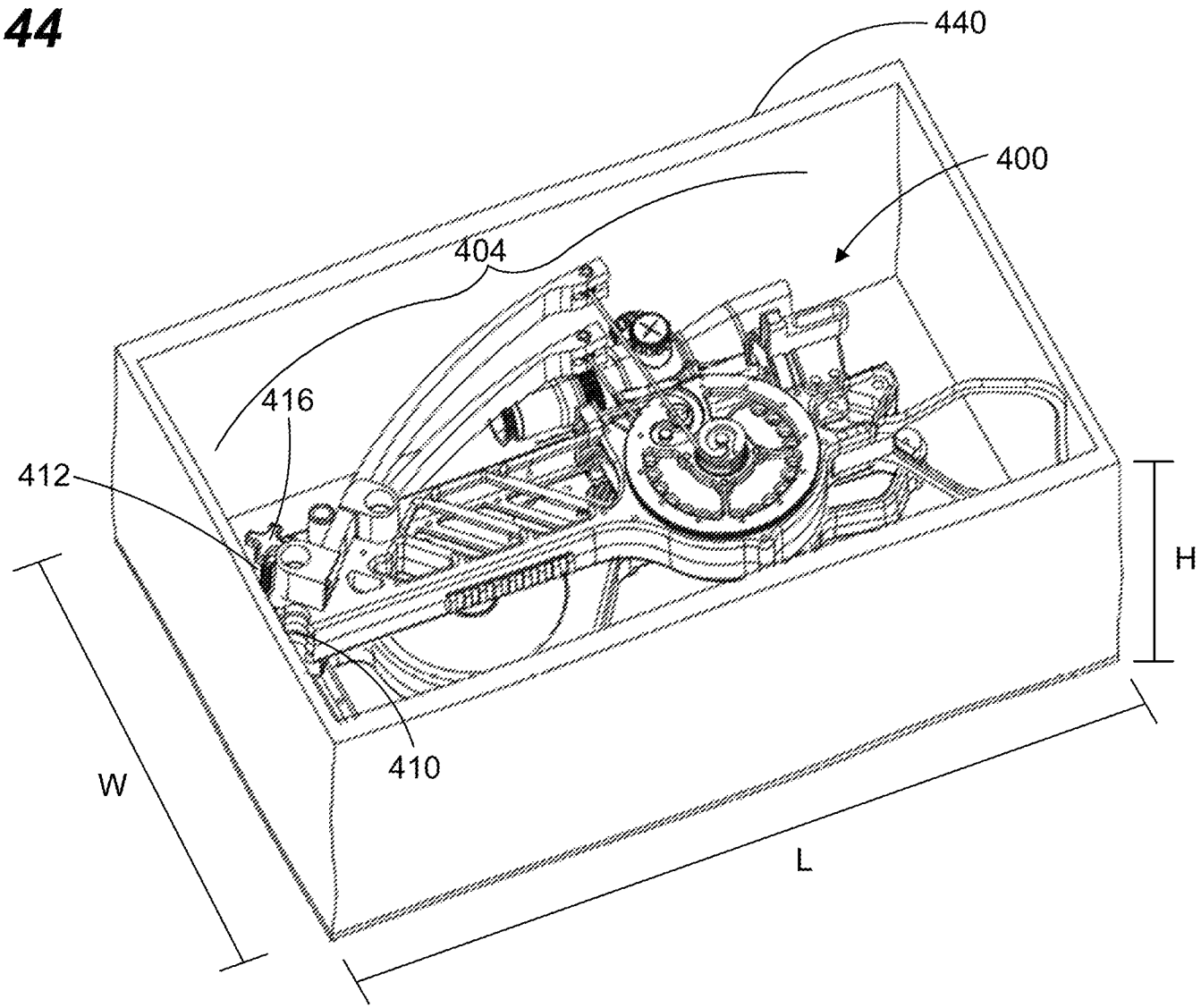
FIG. 44 is a top view of the disassembled crossbow of FIG. 39 arranged in a stacked orientation for transport or storage.
Figure 45:
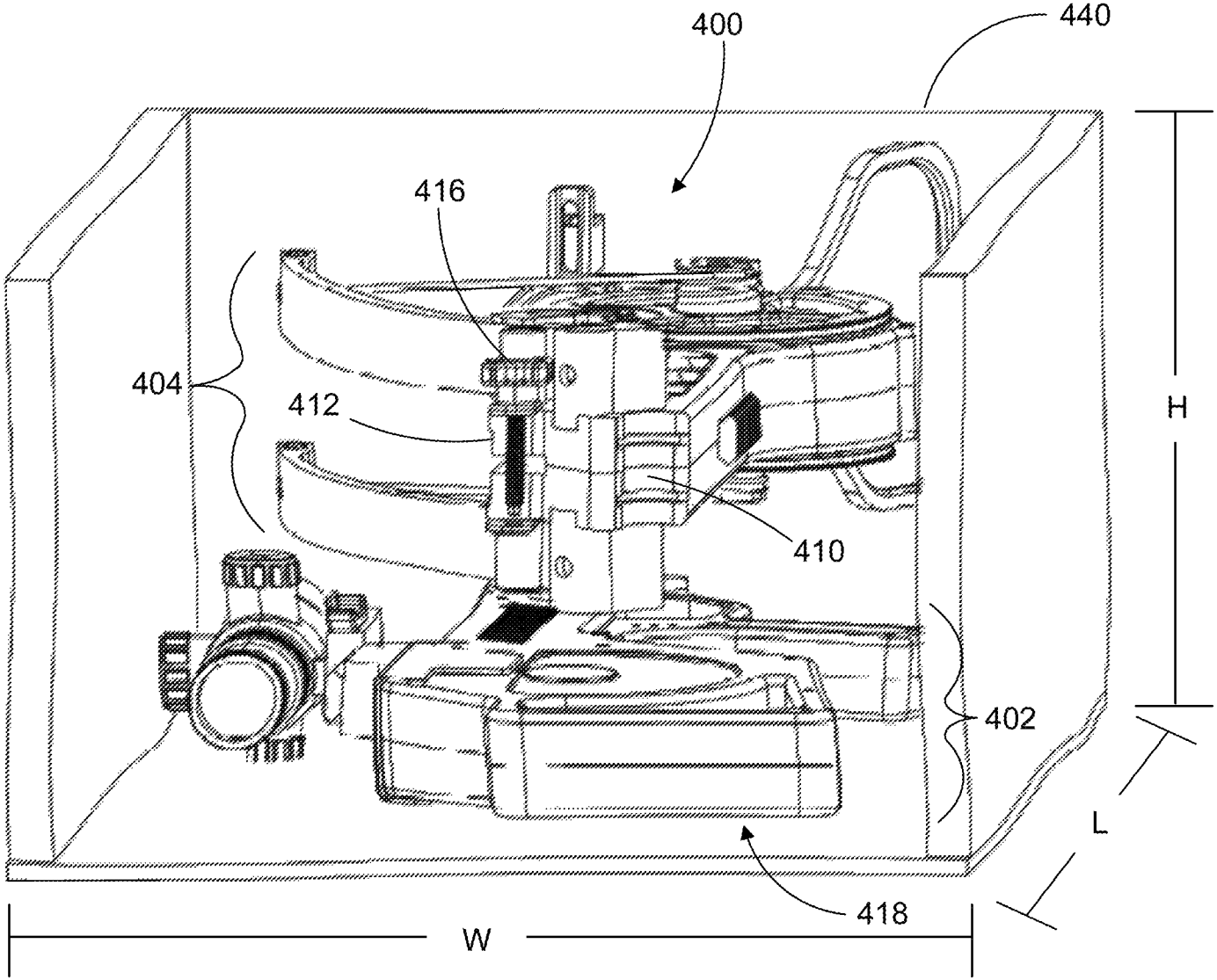
FIG. 45 is a perspective view of the disassembled crossbow of FIG. 39 arranged in a stacked orientation for transport or storage.

When disassembled from one another, the first frame portion 402 and the second frame portion 404 can be arranged in a variety of stacked or nested orientations for shipping, transporting, and/or storing. The manner in which the first and second frame portions 402, 404 are arranged can also protect sensitive components of the crossbow 400, such as a sighting apparatus. FIG. 44 is a top view of the disassembled crossbow 400 of FIG. 39 arranged in a stacked orientation for transport or storage. FIG. 45 is a perspective view of the disassembled crossbow 400 of FIG. 39 arranged in a stacked orientation for transport or storage. In FIGS. 44 and 45, a container 440 holding the disassembled crossbow 400 in the stacked or nested form is a four-sided shipping box, for example. However, for illustration purposes, one side of the container 440 has been removed to show how the disassembled crossbow 400 is arranged therein. In FIG. 44, a top of the container 440 has been removed, and in FIG. 45 a side of the container 440 has been removed.

The overall size of the disassembled crossbow 400 in stacked or nested form is significantly more compact than conventional crossbows having break down capabilities. For example, the disassembled crossbow 400 in stacked or nested form can fit within a container, such as the container 440, that has a length (L) between about 10 to 24 inches, a width (W) between about 4 to 20 inches, and a height (h) between about 3 to 8 inches.

FIGS. 37-45 have illustrated the crossbow 400 having the two detachably coupled frame portions 402, 404 as being substantially similar to crossbow 100 drawn in FIGS. 1-17 that has forward vertically facing limbs 106, 108. In other examples, the crossbow 400 can be substantially similar to the crossbow 200 drawn in FIGS. 18-26 that has the rearward facing parallel first and second limbs 206, 208. In further examples, the crossbow 400 can be substantially similar to the crossbow 300 drawn in FIGS. 27-36 that has the forward facing parallel first and second limbs 306, 308. In each of these alternative examples, positions at which the frame portions 402, 404 attach and detach from one another via the fastening mechanism 406 can be selected based on the particular configuration of the crossbow 200 or the crossbow 300 to prevent disruption or interference with the mechanical assemblies of the crossbow 200 or the crossbow 300, respectively, when disassembled. For example, for both crossbow 200 and crossbow 300, the second end 420 of the first frame portion 402 can be positioned forward from the latch and trigger assembly. For crossbow 200, the first end 422 of the second frame portion 404 can be positioned rearward of the power cable guides 233, 235. For crossbow 300, the first end 422 of the second frame portion 404 can be positioned rearward of the mount 307 to which the limbs 306, 308 attach.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A crossbow comprising:

a frame having a stock positioned at a rear end, the frame defining a horizontal projectile plane at a top side in which a projectile axis is positioned, wherein a projectile moves within the horizontal projectile plane and along the projectile axis during firing and arming of the crossbow, wherein the projectile is fired from a front end of the frame;

a drawstring hub rotatable about a central axis in a first direction and a second direction, the central axis being perpendicular to the projectile axis, the drawstring hub being configured to be connected to a drawstring at a first end and a second end, the drawstring traveling at least partially perpendicular to the projectile axis between the first and the second ends, the drawstring being movable within the projectile plane during firing and arming of the crossbow, wherein movement of the drawstring toward the rear end of the frame corresponds with rotation of the drawstring hub in the first direction, and wherein movement of the drawstring toward the front end of the frame corresponds with rotation of the drawstring hub in the second direction, wherein rotation of the drawstring hub in the second direction is powered;

first and second drawstring guides attached to the frame, each guide guiding the drawstring across the projectile axis between the first and second ends of the drawstring, wherein the first and second drawstring guides each include a pulley wheel, wherein the drawstring is guided at least partially around each pulley wheel; and the first and second drawstring guides positioned between the central axis of the drawstring hub and the stock.

2. The crossbow of claim 1, further comprising a drawstring.

3. The crossbow of claim 2, further comprising a latch and a trigger assembly, the latch being configured to hold the drawstring at the rear end of the frame when the crossbow is drawn, the trigger assembly being in communication with the latch, and wherein upon activation of the trigger assembly when firing, the trigger assembly moves the latch and the drawstring is released.

4. The crossbow of claim 3, further comprising and first and second flexible limbs each having a first end attached to the frame, wherein the first and second flexible limbs are in an unloaded position when the crossbow is undrawn and in a loaded positioned when the crossbow is drawn, and wherein rotation of the drawstring hub in the second direction is powered by the first and second flexible limbs.

5. The crossbow of claim 4, wherein when the trigger assembly is activated when the crossbow is fired, a tension force in the limbs moves the drawstring toward the front end of the frame.

6. The crossbow of claim 4, wherein the first and second limbs extend in an upward and forward direction from the top side of the frame, vertical to the horizontal projectile plane, such that the projectile passes between the first and second limbs.

7. The crossbow of claim 4, wherein the first and second limbs extend in a downward and forward direction from the top side of the frame, vertical to the horizontal projectile plane, such that the projectile passes between the first and second limbs.

8. The crossbow of claim 4, wherein the first and second limbs extend outwardly from the top side of the frame in planes horizontal to the horizontal projectile plane.

9. The crossbow of claim 4, wherein the first and second limbs are each supported by at a main support and a mid support, each mid support being between the main support and the second end of each the first and second limbs.

10. The crossbow of claim 4, further comprising first and second power cables each having first and second ends, wherein the first ends of the first and second power cables are attached to drawstring hub, wherein the second end of the first power cable is attached to second end of the first limb and the second end of the second power cable is attached to second end of the second limb, wherein upon rotation in the first direction of the drawstring hub, the first and second power cables draw the second end of each of the first and second flexible limbs closer to the drawstring hub.

11. The crossbow of claim 10, further comprising a drawstring, wherein when the crossbow is drawn, the drawstring is positioned at the rear end of the frame, wherein the first and second power cables are wound around the drawstring hub, and wherein, upon firing, the first and second power cables are unwound from the drawstring hub.

12. The crossbow of claim 1, further comprising first and second power wheels mounted to the drawstring hub to rotate with the drawstring hub, wherein the first and second power wheels have diameters greater than a diameter of the drawstring hub, and wherein the first end of the drawstring is configured to be attached to the first power wheel and the second end of the drawstring is configured to be attached to the second power wheel.

13. The crossbow of claim 12, wherein when undrawn, the drawstring is configured to be wrapped around the first and second power wheels less than or equal to once.

14. The crossbow of claim 1, further comprising first and second drawstring wheels mounted to the drawstring hub to rotate with the drawstring hub, wherein the first and second drawstring wheels are attached to first and second power cables.

15. The crossbow of claim 1, wherein the frame comprises a first frame portion detachably coupled to a second frame portion via a fastening mechanism.

16. A crossbow comprising:

a frame having a stock positioned at a rear end, the frame defining a horizontal projectile plane at a top side in which a projectile axis is positioned, wherein a projectile moves within the horizontal projectile plane and along the projectile axis during firing and arming of the crossbow, wherein the projectile is fired from a front end of the frame;

a drawstring hub rotatable about a central axis in a first direction and a second direction, the central axis being perpendicular to the projectile axis;

a drawstring being connected to the drawstring hub at a first end and a second end, the drawstring traveling at least partially perpendicular to the projectile axis between the first and the second ends, the drawstring being movable within the projectile plane during firing and arming of the crossbow, wherein movement of the drawstring from the drawstring hub toward the rear end of the frame corresponds with rotation of the drawstring hub in the first direction, and wherein movement of the drawstring toward the drawstring hub from the rear end of the frame corresponds with rotation of the drawstring hub in the second direction;

a latch configured to hold the drawstring at the rear end of the frame when the crossbow is drawn;

a trigger assembly in communication with the latch, wherein upon activation of the trigger assembly when firing, the trigger assembly moves the latch and the drawstring is released;

first and second flexible limbs each having a first end attached to the frame, wherein the first and second flexible limbs are in an unloaded position when the crossbow is undrawn and in a loaded positioned when the crossbow is drawn;

first and second power cables each having first and second ends, wherein the first ends of the first and second power cables are attached to the drawstring hub, wherein the second end of the first power cable is attached to second end of the first limb and the second end of the second power cable is attached to second end of the second limb, wherein upon rotation in the first direction of the drawstring hub, the first and second power cables draw the second end of each first and second flexible limb closer to the drawstring hub; and first and second drawstring guides positioned between the central axis of the drawstring hub and the stock, the first and second drawstring guides attached to the frame, each drawstring guide guiding the drawstring across the projectile axis between the first and second ends of the drawstring.

17. The crossbow of claim 16, further comprising first and second power wheels mounted to the drawstring hub to rotate with the drawstring hub, wherein the first and second power wheels have diameters greater than a diameter of the drawstring hub, and wherein the first end of the drawstring is attached to the first power wheel and the second end of the drawstring is attached to the second power wheel.

18. The crossbow of claim 17, wherein when undrawn, the drawstring is wrapped around the first and second power wheels less than or equal to once.

19. The crossbow of claim 16, wherein, upon firing, the first and second power cables are unwound from the drawstring hub.

20. The crossbow of claim 16, further comprising an accessory rail at the top side of the frame.

21. The crossbow of claim 16, further comprising a grip and a trigger guard positioned at the rear end of the frame, wherein the trigger guard surrounds a portion of the trigger assembly.

22. The crossbow of claim 16, further comprising a projectile rest attached to the front end of the frame, the projectile rest having an opening aligned with the projectile axis.

23. The crossbow of claim 16, wherein the first and second drawstring guides each include a pulley wheel, and wherein the drawstring is guided at least partially around each pulley wheel when the crossbow is in the unloaded position, and wherein the drawstring is guided substantially straight along the pulley wheels when the crossbow is in the loaded position.

24. The crossbow of claim 16, wherein the frame comprises a first frame portion detachably coupled to a second frame portion via a fastening mechanism, each of the first frame portion and the second frame portion having a first end and a second end.

25. The crossbow of claim 24, wherein the fastening mechanism is a pivot lock joint comprising a female pivot, a male pivot, a female lock, a male lock, and a lock knob bolt.

26. The crossbow of claim 25, wherein the second end of the first frame portion includes the male pivot and the female lock and the first end of the second frame portion includes the female pivot and the male lock such that the second end of the first frame portion is detachably coupled to the first end of the second frame portion.

27. The crossbow of claim 24, wherein the second end of the first frame portion is positioned forward from the latch and the trigger assembly.

28. The crossbow of claim 24, wherein the first end of the second frame portion is positioned rearward from one or more of the drawstring hub, the first and second flexible limbs, the first and second power cables, and the first and second drawstring guides.

* * * * *